US009280098B2

(12) United States Patent
Kanno

(10) Patent No.: US 9,280,098 B2
(45) Date of Patent: Mar. 8, 2016

(54) IMAGE FORMING APPARATUS

(71) Applicant: CANON KABUSHIKI KAISHA, Tokyo (JP)

(72) Inventor: Naoki Kanno, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/606,357

(22) Filed: Jan. 27, 2015

(65) Prior Publication Data

US 2015/0212457 A1 Jul. 30, 2015

(30) Foreign Application Priority Data

Jan. 28, 2014 (JP) ..... 2014-013804

(51) Int. Cl.
*G03G 15/16* (2006.01)

(52) U.S. Cl.
CPC ..... *G03G 15/1665* (2013.01); *G03G 15/1605* (2013.01)

(58) Field of Classification Search
CPC ..... G03G 15/1605; G03G 15/1665; G03G 21/168
See application file for complete search history.

(56) References Cited

U.S. PATENT DOCUMENTS

| | | | | |
|---|---|---|---|---|
| 7,509,082 | B2 * | 3/2009 | Goto | 399/301 |
| 7,917,047 | B2 * | 3/2011 | Takishita | 399/49 |
| 8,238,773 | B2 * | 8/2012 | Usami et al. | 399/66 |

FOREIGN PATENT DOCUMENTS

| | | | |
|---|---|---|---|
| JP | 2004-20700 | A | 1/2004 |
| JP | 2007-171588 | A | 7/2007 |
| JP | 2008-180790 | A | 8/2008 |
| JP | 2009-98498 | A | 5/2009 |
| JP | 2010-134320 | A | 6/2010 |
| JP | 2012-137733 | A | 7/2012 |

* cited by examiner

*Primary Examiner* — Gregory H Curran
(74) *Attorney, Agent, or Firm* — Canon USA, Inc. IP Division

(57) ABSTRACT

An image forming apparatus includes a switching unit that can switch polarities of potentials of an intermediate transfer member generated at a primary transfer part and a secondary transfer part in synchronization, and a control unit that executes adjustment processing in which a potential having a polarity opposite to the polarity upon the transfer is generated at least one of the primary transfer part and the secondary transfer part, in which the control unit controls the switching unit in a manner that, in a case where the adjustment processing is performed in a course of continuous image formation on a plurality of transfer materials conveyed to the secondary transfer part, a timing for generating the potential having the opposite polarity corresponds to a timing at which toner images are not transferred at both of the primary transfer part and the secondary transfer part.

16 Claims, 14 Drawing Sheets

IMAGE FORMING APPARATUS

BACKGROUND OF THE INVENTION

1. Field of the Invention

The present invention relates to an image forming apparatus that employs an electrophotographic system, an electrostatic recording system, or the like.

2. Description of the Related Art

Up to now, for example, as an image forming apparatus of an electrophotographic system, an image forming apparatus that adopts an intermediate transfer system in which, after a toner image formed on a photosensitive member is primarily transferred onto an intermediate transfer member, the toner image is secondarily transferred onto a transfer material such as paper has been proposed. In general, a primary transfer member is provided for a primary transfer part, and a secondary transfer member is provided for a secondary transfer part. Voltages from independent power sources are applied to the primary transfer member and the secondary transfer member, respectively and potentials for primary transfer and secondary transfer are respectively generated at the primary transfer part and the secondary transfer part.

Japanese Patent Laid-Open No. 2012-137733 proposes an image forming apparatus that adopts the intermediate transfer system and that causes a current to flow in a circumferential direction of the intermediate transfer member from the secondary transfer part and performs both primary transfer and secondary transfer. In this case, an endless belt having a conductivity at which a current can flow in the circumferential direction is used as the intermediate transfer member, and a voltage is applied to the secondary transfer member to cause the current to flow through the belt.

In addition, up to now, the image forming apparatus executes various adjustment processes for an image quality adjustment, a status check, and the like. For example, when images are continuously formed, the image forming processing may be temporarily interrupted to perform the adjustment processing in a case where a certain condition (processing execution condition) is met. In this case, after the adjustment processing is ended, the image forming apparatus resumes the interrupted image formation. As an example of the adjustment processing, processing of periodically supplying toner to a cleaning unit has been proposed to suppress turn-up or the like of a cleaning blade that removes toner from the photosensitive member. Since the toner is periodically supplied to the cleaning unit, lubrication between the cleaning blade and the photosensitive member is realized (hereinafter, this processing may also be referred to as "discharge processing").

A timing for executing the discharge processing is generally determined on the basis of a number of sheets subjected to image formation, a printing ratio, or the like. The image forming apparatus temporarily interrupts the image forming processing when the processing execution condition (discharge processing execution condition) set by using the above-described number of sheets subjected to the image formation, the printing ratio, or the like as an index is met, and forms on the photosensitive member a toner image to be supplied to the cleaning unit. This toner image is supplied to the cleaning unit without being transferred to the intermediate transfer member while a potential generated at the primary transfer part is set to have the opposite polarity with respect to the polarity upon the primary transfer. The image forming apparatus then resumes the image formation after the discharge processing is ended.

According to the configuration in which the power sources are respectively provided for the primary transfer part and the secondary transfer part, it is possible to generate potential having predetermined polarities at the primary transfer part and the secondary transfer part by independently controlling respective voltages and currents. With such configuration, in a case where the adjustment processing such as the discharge processing is executed, the potential having a predetermined polarity can be independently generated at the primary transfer part irrespective of the polarity of the potential generated at the secondary transfer part, and the adjustment processing can be executed.

However, as disclosed in Japanese Patent Laid-Open No. 2012-137733, since the respective polarities of the potentials generated at the primary transfer part and the secondary transfer part cannot be independently controlled, it is difficult to execute the adjustment processing.

SUMMARY OF THE INVENTION

In view of the above, the present invention provides an image forming apparatus in which image formation can be started more quickly after adjustment processing is performed, and a reduction in productively can be suppressed in a configuration in which polarities of potentials generated at a primary transfer part and a secondary transfer part cannot be independently controlled.

According to an aspect of the present invention, there is provided an image forming apparatus including: an image bearing member that bears a toner image; an intermediate transfer member that is rotatable and transfers a toner image transferred from the image bearing member at a primary transfer part onto a transfer material at a secondary transfer part; a switching unit that can switch polarities of potentials of the intermediate transfer member which are generated at the primary transfer part and the secondary transfer part in synchronization; and a control unit that executes an adjustment processing in which a potential having a polarity opposite to the polarity upon the transfer is to be generated at least one of the primary transfer part and the secondary transfer part, in which the control unit controls the switching unit in a manner that, in a case where the adjustment processing is performed in a course of continuous image formation on a plurality of transfer materials conveyed to the secondary transfer part, a timing for generating the potential having the opposite polarity corresponds to a timing at which toner images are not transferred at both of the primary transfer part and the secondary transfer part.

Further features of the present invention will become apparent from the following description of exemplary embodiments with reference to the attached drawings.

DESCRIPTION OF THE EMBODIMENTS

Hereinafter, an image forming apparatus according to exemplary embodiments of the present invention will be described in further detail with reference to the drawings.

First Exemplary Embodiment

1. Overall Configuration and Operation of Image Forming Apparatus

Figure 1:
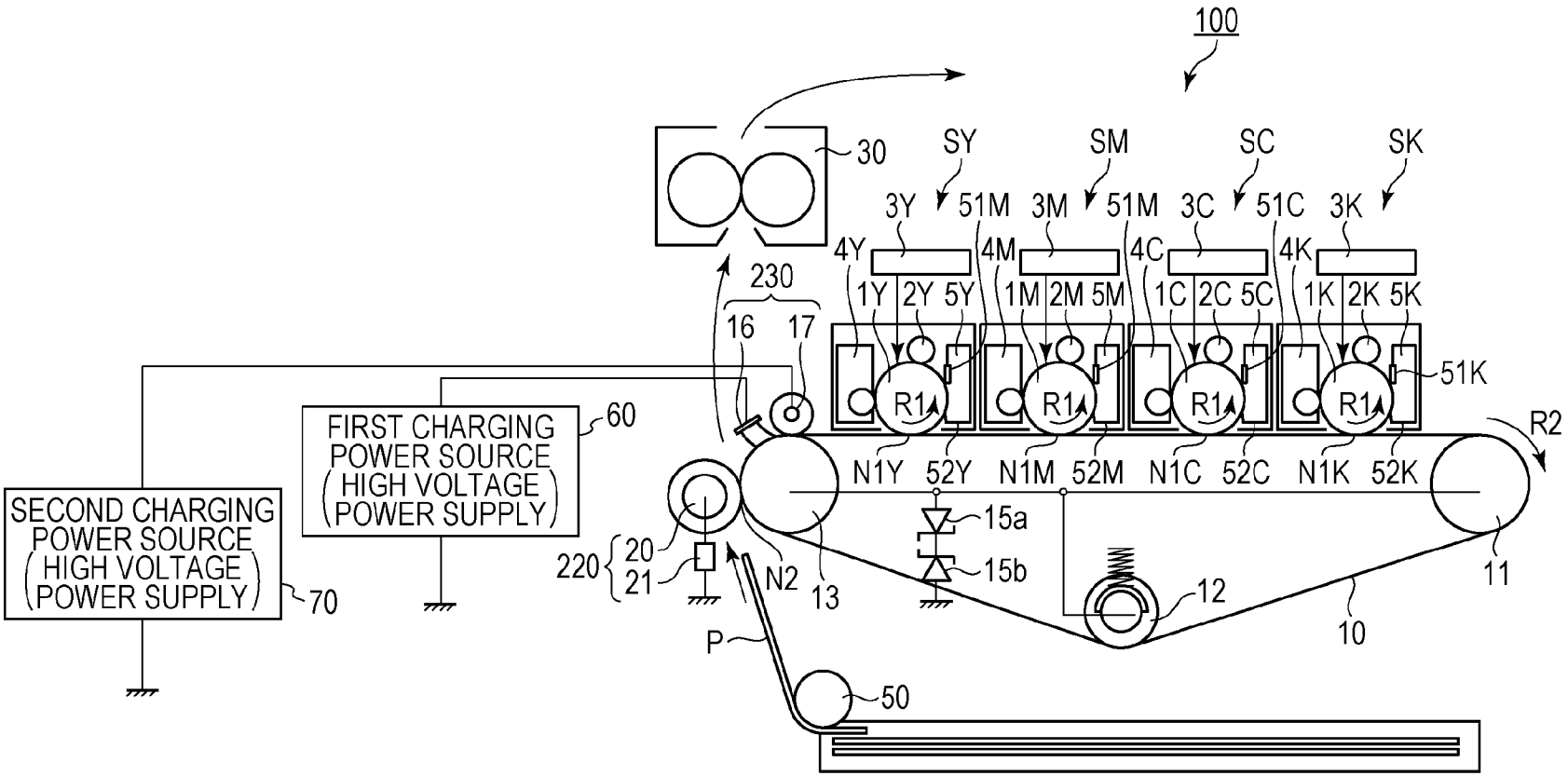
FIG. 1 is a schematic diagram of an image forming apparatus.

FIG. 1 is a schematic diagram of an image forming apparatus according to an exemplary embodiment of the present invention. The image forming apparatus according to the present exemplary embodiment is a laser beam printer that adopts an intermediate transfer system and an in-line system (four-combined drum system) with which a full-color print image can be output by using an electrophotographic system.

An image forming apparatus 100 includes first, second, third, and fourth image forming units (stations) SY, SM, SC, and SK as a plurality of image forming units. The first, second, third, and fourth image forming units SY, SM, SC, and SK respectively form yellow (Y), magenta (M), cyan (C), and black (K) images. These image forming units are arranged in line at certain intervals. According to the present exemplary embodiment, configurations and operations of the respective image forming units SY, SM, SC, and SK are substantially the same except for toner colors to be used. Therefore, hereinafter, in a case where no particular distinction is required, trailing characters Y, M, C, and K of the reference symbols which represent the elements provided for one of the colors are omitted, and such elements will be generally described.

The image forming unit S includes a photosensitive drum 1 corresponding to a drum-type (cylindrical) electrophotographic photosensitive member as an image bearing member. The photosensitive drum 1 is rotated and driven in an arrow R1 direction in the drawing. The rotating photosensitive drum 1 is subjected to charging processing to be substantially uniformly charged at a predetermined potential having a predetermined polarity (negative polarity according to the present exemplary embodiment) by a charging roller 2 corresponding to a roller-like charging member as a charging unit. The charged photosensitive drum 1 is subjected to scanning exposure in accordance with image information by an exposure apparatus (laser scanner apparatus) 3 functioning as an exposure unit. Accordingly, electrostatic latent images (electrostatic images) in accordance with image information of color components corresponding to the respective image forming units S are formed on the photosensitive drum 1. The electrostatic latent images formed on the photosensitive drum 1 are developed (visualized) at developing positions by using toner as developer by a developing apparatus 4 functioning as a developing unit. Accordingly, the toner images in accordance with the image information of the color components corresponding to the respective image forming units S are formed on the photosensitive drum 1. According to the present exemplary embodiment, the developing apparatus 4 causes the toner charged to have the same polarity as the charging polarity of the photosensitive drum 1 to be adhered at an exposure part on the photosensitive drum 1 exposed to have an absolute value of the potential is decreased after being subjected to be uniformly charged and forms toner images (reversal development). According to the present exemplary embodiment, the charging polarity at the development of the toner accommodated in the developing apparatus 4 (regular charging polarity of the toner) is the negative polarity. The toner image on the photosensitive drum 1 is transferred onto an intermediate transfer belt 10 (primary transfer) in the course of passing through a primary transfer part (primary transfer nip) N1 corresponding to an abutting part formed by the photosensitive drum 1 and the intermediate transfer belt 10 functioning as a rotatable intermediate transfer member. A potential and the like generated at the primary transfer part N1 will be described below.

The remaining toner on a front surface of the photosensitive drum 1 after the primary transfer (primary transfer residual toner) is removed by a cleaning apparatus 5 functioning as a cleaning unit to be collected. The cleaning apparatus 5 includes a cleaning blade 51 functioning as a cleaning member and a collection container 52. The cleaning blade 51 is a plate-like member formed of an elastic material such as polyurethane rubber and is arranged while abutting against the photosensitive drum 1. The cleaning blade 51 scrapes the toner from the rotating photosensitive drum 1 to be removed and collected into the collection container 52. After the photosensitive drum 1 is cleaned by the cleaning apparatus 5, the photosensitive drum 1 is used again for the image forming process after the charging.

For example, when a full-color image is formed, the above-described respective processes including the charging, the exposure, the development, and the primary transfer are similarly performed in the first, second, third, and fourth image forming units SY, SM, SC, and SK. The toner images having the respective colors of yellow, magenta, cyan, and black are then primarily transferred to be sequentially overlapped with each other onto the intermediate transfer belt 10. As a result, a composite color image (multiplex toner image) corresponding to a target color image is obtained on the intermediate transfer belt 10.

The toner image on the intermediate transfer belt 10 is transferred onto a transfer material P (secondary transfer) in the course of passing through a secondary transfer part (secondary transfer nip) N2 corresponding to a contact part formed by the intermediate transfer belt 10 and a secondary transfer roller 20 functioning as a roller-like secondary transfer member functioning as a secondary transfer unit. In a case where the toner image on the intermediate transfer belt 10 is the multiplex toner image, the overlapped toner of the plurality of colors is collectively transferred onto the transfer material P. The transfer material P is supplied to the secondary transfer part N2 by a transfer material supply roller 50 or the like functioning as a transfer material supply unit. A transfer power source (high-voltage power source) 21 constituting a potential generation unit is connected to the secondary transfer roller 20. While the secondary transfer roller 20 is applied with a predetermined voltage from the transfer power source 21, a predetermined potential having a predetermined polarity is generated at the secondary transfer part N2. In more detail, the predetermined potential having the positive polarity (opposite polarity with respect to the regular charging polarity of the toner) is generated on the secondary transfer roller 20 at the secondary transfer part N2. This predetermined potential is high on the side of the positive polarity (opposite polarity with respect to the regular charging polarity of the toner) with respect to the potential on the intermediate transfer belt 10 which will be described below. Accordingly, with the action of the potential difference (electric field) formed between the intermediate transfer belt 10 and the secondary transfer roller 20 at the secondary transfer part N2, the toner image charged to have the negative polarity on the intermediate transfer belt 10 is moved onto the transfer material P, and the secondary transfer is thus performed.

Thereafter, the transfer material P that bears the unfixed toner image is introduced to a fixing apparatus 30 functioning as a fixing unit, and the toner thereon is fused and fixed by way of heating and pressurization here. In a case where the unfixed toner image on the transfer material P is the multiplex toner image, the toner of the plurality of colors is fused and mixed with each other at this time and fixed on the transfer material P. As a result of the above-described operation, for example, the full-color print image is formed.

The toner remaining on a front surface of the intermediate transfer belt 10 after the secondary transfer (secondary transfer residual toner) is charged by the charging device 230. Specifically, the secondary transfer residual toner is substantially evenly diffused by a conductive blush 16 arranged while abutting against the intermediate transfer belt 10 and is also subjected to the charging processing. Thereafter, the secondary transfer residual toner on the intermediate transfer belt 10 is applied with electric charges by a conductive roller 17 arranged while abutting against the intermediate transfer belt 10. A first charging power source (high-voltage power source) 60 is connected to the conductive blush 16, and a predetermined voltage is applied from the first charging power source 60. A second charging power source (high-voltage power source) 70 is connected to the conductive roller 17, and a predetermined voltage is applied from the second charging power source 70. The toner applied with the electric charges having the predetermined polarity (positive polarity that is the opposite polarity with respect to the regular charging polarity) by the conductive roller 17 is reversely transferred to the photosensitive drum 1 (at least one of four photosensitive drums 1Y, 1M, 1C, and 1K) at the time of the next primary transfer. Then, the secondary transfer residual toner adhered to the photosensitive drum 1 is collected together with the primary transfer residual toner by the cleaning apparatus 5.

2. Configuration and Control of Primary Transfer Part

The intermediate transfer belt 10 functioning as the intermediate transfer member is arranged so as to face the respective photosensitive drums 1Y, 1M, 1C, and 1K of the respective image forming units SY, SM, SC, and SK. The intermediate transfer belt 10 is constituted by an endless belt provided to have a conductivity by adding a conducting agent to a resin material. The intermediate transfer belt 10 is wound around three rollers (three axes) including a drive roller 11, a tension roller 12, and a secondary transfer facing roller 13 which function as a plurality of supporting members (stretching rollers). The intermediate transfer belt 10 is biased by a spring functioning as a biasing unit in a direction where the tension roller 12 moves from an inner periphery of the intermediate transfer belt 10 towards an outer periphery and is accordingly wound around the above-described three rollers in a state in which a predetermined tension is applied to the intermediate transfer belt 10. As indicated by an arrow R2 in the drawing, the intermediate transfer belt 10 is rotated and driven at a substantially same circumferential speed as a circumferential speed (process speed) of the photosensitive drum 1 in a direction where the mutual surface movement directions are set to be the same directions at the abutting part against the photosensitive drum 1.

Subsequently, according to the present exemplary embodiment, a current is caused to flow in a circumferential direction of the intermediate transfer belt 10 to charge the intermediate transfer belt 10, and a potential is generated at the primary transfer part N1 by using the transfer power source 21, the first charging power source 60, and the second charging power source 70. In more detail, a predetermined potential having the positive polarity (opposite polarity with respect to the regular charging polarity of the toner) is generated on the intermediate transfer belt 10 at the primary transfer part N1. This predetermined potential is high on the side of the positive polarity (opposite polarity with respect to the regular charging polarity of the toner) with respect to the potential on the photosensitive drum 1. Accordingly, with the action of the potential difference (electric field) formed between the intermediate transfer belt 10 and the photosensitive drum 1 at the primary transfer part N1, the toner charged to have the negative polarity on the photosensitive drum 1 is moved onto the intermediate transfer belt 10, and the primary transfer is thus performed. The currents from the secondary transfer roller 20, the conductive blush 16, and the conductive roller 17 are overlapped with each other to flow in the circumferential direction of the intermediate transfer belt 10.

According to the present exemplary embodiment, the drive roller 11, the tension roller 12, and the secondary transfer facing roller 13 are electrically grounded (connected to ground) via two zener diodes 15*a* and 15*b* connected in series and also in mutually opposing directions. Zener voltages of the two zener diodes 15*a* and 15*b* are both set as 300 V. The zener diode has a current to flow through when the zener voltage is exceeded because of its characteristics and maintains the zener voltage. Therefore, even in a case where the voltage applied from the transfer power source 21 to the secondary transfer roller 20 is increased, it is possible to maintain the potential on the intermediate transfer belt 10 to be constant and stabilize the primary transferability.

For further explanations, according to the present exemplary embodiment, the currents flow through the drive roller 11, the tension roller 12, and the secondary transfer facing roller 13 via the intermediate transfer belt 10 from the transfer power source 21, the first charging power source 60, and the second charging power source 70. As a result, potentials (±300 V) in accordance with the zener voltages of the zener diodes 15*a* and 15*b* are generated at the drive roller 11, the tension roller 12, and the secondary transfer facing roller 13. Then, the potentials at the drive roller 11, the tension roller 12, and the secondary transfer facing roller 13 are maintained at ±300 V. In a case where the overlapped voltage (overlapped current) from the transfer power source 21, the first charging power source 60, and the second charging power source 70 has the positive polarity, the potentials at the drive roller 11, the tension roller 12, and the secondary transfer facing roller 13 are maintained at +300 V by the zener diode 15*a*. Similarly, in a case where the overlapped voltage has the negative polarity, the potentials are maintained at −300 V by the zener diode 15*b*. For that reason, a potential on a back surface of the intermediate transfer belt 10 is also maintained at ±300 V. That is, in a case where the overlapped voltage (overlapped current) from the transfer power source 21, the first charging power source 60, and the second charging power source 70 has the positive polarity, the potential on the back surface of the intermediate transfer belt 10 is maintained at +300 V, and the potential is maintained at −300 V in the case of the negative polarity.

It is noted that, according to the present exemplary embodiment, since the intermediate transfer belt 10 has a predetermined electrical resistance but also has a sufficient conductivity, the potential on the back surface and the potential on the front surface become almost the same potentials across the substantially entire region in the circumferential direction of the intermediate transfer belt 10. Therefore, this potential on the back surface of the intermediate transfer belt 10 may also be simply referred to as potential on the intermediate transfer belt 10.

Herein, a reason why one of the zener diodes is reversely connected is that a stable potential is to be supplied to the primary transfer part N1 even upon application of a voltage having the opposite polarity such as a time when the discharge processing or the like which will be described below is performed.

At least the transfer power source 21 and the secondary transfer roller 20 are provided as a switching unit 220 that can switch the polarities of the potentials at the intermediate transfer belt 10 which are generated at the primary transfer part and the secondary transfer part in synchronization. According to the present exemplary embodiment, the switching unit 220 includes a charging device 230 and a charging power source 60 and 70 together with the transfer power source 21 and the secondary transfer roller 20. It is noted that, to facilitate understanding, the following description particularly focuses on the polarity of the voltage from the transfer power source 21 as the power source that generates the potentials at the primary transfer part N1 and the secondary transfer part N2. It is however noted that, according to the present exemplary embodiment, the polarities of the voltages from the first charging power source 60 and the second charging power source 70 are also set to be switched in synchronization with the polarity of the voltage from the transfer power source 21.

3. Image Forming Apparatus System Configuration

Figure 2:
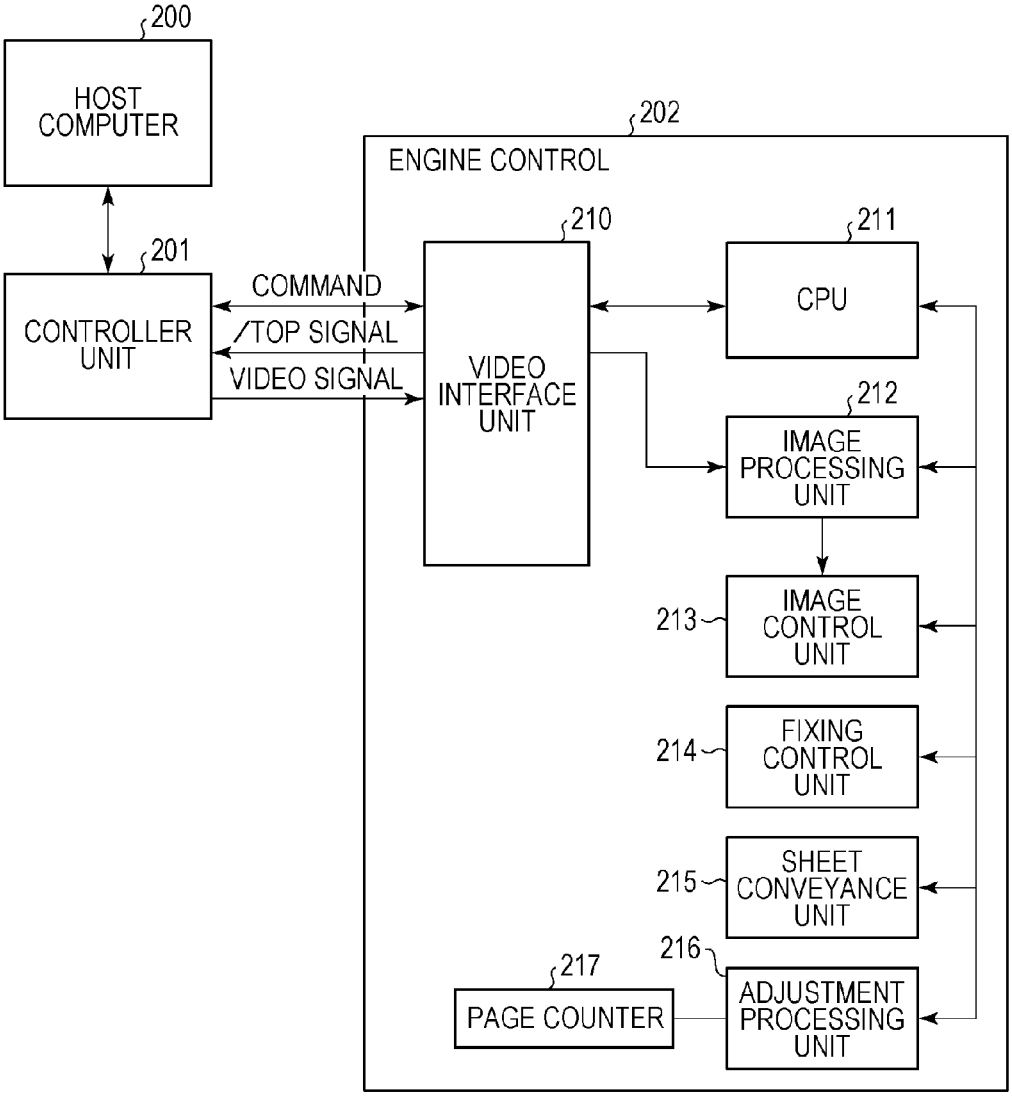
FIG. 2 is a system configuration diagram of the image forming apparatus.

FIG. 2 is a block diagram for describing a system configuration of the image forming apparatus according to the present exemplary embodiment 100.

A controller unit 201 can mutually communicate with a host computer 200 and an engine control 202 corresponding to an example of a control unit. The controller unit 201 receives image information and a print command from the host computer 200 and analyzes the received image information to be converted into bit data. The controller unit 201 then transmits a print reservation command, a print starting command, and a video signal to a CPU 211 and an image processing unit 212 via a video interface unit 210 for each transfer material P. The controller unit 201 transmits the print reservation command in accordance with the print command from the host computer 200 to the CPU 211 via the video interface unit 210 and transmits the print starting command to the CPU 211 at a timing when the print can be performed.

The CPU 211 performs print execution preparation in the order of the print reservation command from the controller unit 201 and waits for the print starting command from the controller unit 201. When the print instruction is received, the CPU 211 instructs respective control units (an image control unit 213, a fixing control unit 214, and a sheet conveyance unit 215) to start print operation in accordance with the information of the print reservation command. When the print operation starting instruction is received, the image control unit 213 starts preparation of the image formation. When a notification indicating that the preparation of the image formation is ready is received from the image control unit 213, the CPU 211 outputs a /top signal corresponding to an output reference timing of the video signal to the controller unit 201. When the /top signal is received from the CPU 211, the controller unit 201 outputs the video signal while the /top signal is used as a reference. When the video signal is received from the controller unit 201, the image processing unit 212 transmits image formation data to the image control unit 213. The image control unit 213 instructs to perform the image formation based on the image formation data received from the image processing unit 212.

When the print operation starting instruction is received, the sheet conveyance unit 215 starts sheet feeding operation. A sheet feeding conveyance control unit (not illustrated) of the sheet conveyance unit 215 rotates a stepping motor (not illustrated) via a sheet feeding conveyance motor driver IC (not illustrated) and conveys a sheet (transfer material) P to a secondary transfer position. When the print operation starting instruction is received, the fixing control unit 214 starts fixing preparation. The fixing control unit 214 starts temperature control in accordance with the information of the print reservation command in synchronization with a timing at the sheet P which on which the secondary transfer has been performed is conveyed. The fixing control unit 214 fixes the image on the sheet P and conveys the sheet P to the outside of the apparatus.

An adjustment processing unit 216 updates information used for the adjustment processing, and in a case where a predetermined condition (processing execution condition) is met, temporarily interrupts the image formation by the image control unit 213 to execute the adjustment processing. After the adjustment processing is ended, the image control unit 213 resumes the image formation. The adjustment processing, the processing execution condition, and the like according to the present exemplary embodiment will be described below.

4. Discharge Processing

Next, the discharge processing for suppressing the turn-up or the like of the cleaning blade 51 will be described as an example of the adjustment processing by the image forming apparatus 100.

In a case where the processing execution condition (discharge processing execution condition) is met, the adjustment processing unit 216 forms a predetermined toner image for supplying the toner to a cleaning unit (hereinafter, will also be referred to as "discharge toner image") on the photosensitive drum 1. According to the present exemplary embodiment, the discharge toner image is formed by the respective processes including the charging, the exposure, and the development. That is, the front surface of the rotating photosensitive drum 1 is substantially uniformly charged by the charging roller 2. Next, the charged photosensitive drum 1 is exposed by the exposure apparatus 3. According to the present exemplary embodiment, the exposure apparatus 3 exposes an entire image formable region in a main scanning direction at this time. This exposure is performed for a certain period of time to form the toner image constituted by the amount of toner to be supplied to the cleaning unit in the discharge processing. Accordingly, the electrostatic latent image for toner discharge which has a certain width in a sub scanning direction (conveyance direction) is formed on the photosensitive drum 1. Next, this electrostatic latent image is developed as the toner image by the developing apparatus 4. To supply the discharge toner image formed on the photosensitive drum 1 to the cleaning unit, the discharge toner image is to remain on the photosensitive drum 1 without being transferred to the intermediate transfer belt 10. For that reason, the polarity of the potential generated at the primary transfer part N1 is set as the same polarity as the negative polarity corresponding to the regular charging polarity of the toner, that is, the opposite polarity with respect to that upon the primary transfer. The potential having the negative polarity generated at the primary transfer part N1 is held for a certain period of time such that all the discharge toner images remain on the photosensitive drum 1. Accordingly, the discharge toner image that has passed through the primary transfer part N1 is supplied to the cleaning unit and collected to the collection container 52 by the cleaning blade 51. The toner of this discharge toner image provides lubricating effects between the cleaning blade 51 and the photosensitive drum 1.

According to the present exemplary embodiment, a timing at which the discharge processing is executed is determined by using a page counter 217 (FIG. 2) for the discharge processing. In a case where the count value of the page counter 217 reaches a predetermined threshold (X sheets according to the present exemplary embodiment) corresponding to the processing execution condition, after the formation of the image on the X-th sheet is ended, the adjustment processing unit 216 temporarily interrupts the image formation and executes the discharge processing.

In the image forming apparatus according to the present exemplary embodiment 100, in a case where the discharge processing is performed during the continuous image formation, if the polarity of the potential generated at the primary transfer part N1 for the discharge processing is set as the negative polarity, the potential generated at the secondary transfer part N2 is also set as the negative polarity. For that reason, to execute the discharge processing, the secondary transfer is not to be performed at the secondary transfer part N2 during a period from a timing when the polarity of the potential generated at the primary transfer part N1 is switched from the positive polarity to the negative polarity until a timing when the polarity is switched back from the negative polarity to the positive polarity. That is, during the above-described period, a non-image region without the image (toner image) transferred onto the transfer material P to be output is to be located at the secondary transfer part N2. An inter-image region corresponding to a section (region) between one image and another image during the continuous image formation is conceivable as the above-described non-image region.

Herein, in general, the inter-image region in the image forming apparatus is controlled to have a shortest distance (interval) as much as possible to improve the productivity. Therefore, the sufficient distance (interval) for executing the discharge processing cannot be secured by the normally set inter-image region. For that reason, in a case where the discharge processing during the continuous image formation is performed, the discharge processing stands by and is then executed after the image on the X-th sheet which is formed immediately before the image formation is temporarily interrupted passes through the secondary transfer part N2.

In view of the above, according to the present exemplary embodiment, in a case where the discharge processing is executed during the continuous image formation, the non-image region (inter-image region) is set to be located at the secondary transfer part N2 at the timing when the discharge processing is executed, and the sufficient non-image region enough for enabling to execute the processing is also secured. Accordingly, the resumption of the image formation after the discharge processing is advanced, and the decrease in the productivity is suppressed. Hereinafter, the present exemplary embodiment will be described in more detail.

5. Adjustment of Interval of Inter-Image Region

According to the present exemplary embodiment, a situation of the secondary transfer part N2 at the timing at which the discharge processing can be executed (hereinafter, will be also referred to as "processing executable timing") is predicted. Subsequently, the interval of the inter-image region that reaches the secondary transfer part N2 ahead of the image at the primary transfer part N1 immediately before the processing executable timing is adjusted on the basis of the prediction result.

The processing executable timing is a predetermined timing at which the potential having the opposite polarity with respect to the polarity upon the transfer can be generated at the primary transfer part N1 to execute the adjustment processing. That is, the earliest processing executable timing is a timing at which the primary transfer of the image located at the primary transfer part N1 is ended immediately before the processing executable timing. According to the present exemplary embodiment, the earliest processing executable timing is set as a timing at which the primary transfer of the image forming unit SK for black located on the lowermost stream in the movement direction of the intermediate transfer belt 10 at the primary transfer part N1 is ended. The situation of the secondary transfer part N2 at the processing executable timing is predicted as follows. That is, the determination is made on the situation (hereinafter, will be also referred to as "image forming situation") which includes the number of images that are to be at least partially located between the primary transfer part N1 and the secondary transfer part N2 at the processing executable timing in a case where the adjustment for the interval of the inter-image region is not performed, the size, the position, and the like.

Figure 3A:
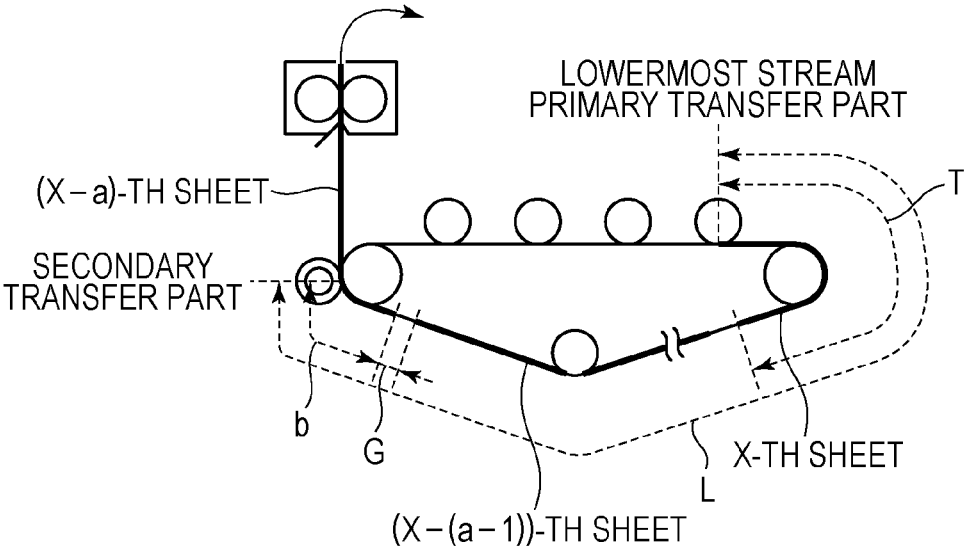
FIGS. 3A and 3B are schematic diagrams illustrating an example of an image forming situation at a processing executable timing.
Figure 3B:
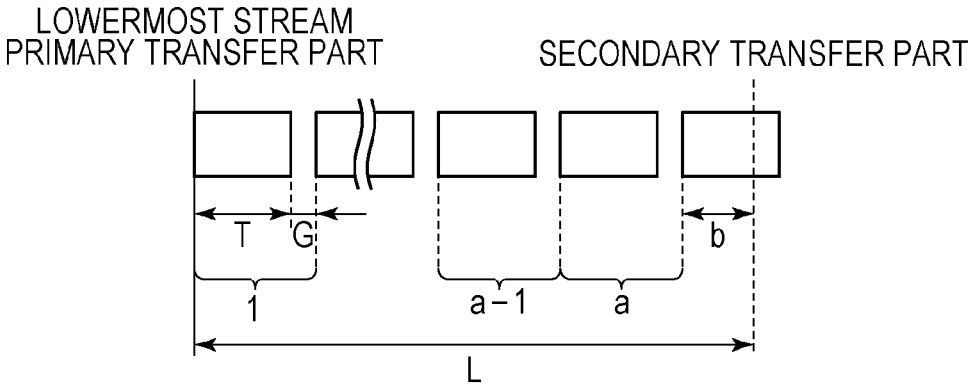

FIGS. 3A and 3B illustrate an example of an image forming situation at the processing executable timing (when the primary transfer of the image on the X-th sheet at the primary transfer part N1 on the lowermost stream is ended) in a case where the adjustment for the interval of the inter-image region is not performed. FIG. 3A is a cross sectional view of the image forming apparatus 100, and FIG. 3B is a schematic diagram illustrating an image forming position on the intermediate transfer belt 10. In the example illustrated in FIG. 3A, the image in the course of the secondary transfer passes through the secondary transfer part N2 at the processing executable timing. Herein, T, G, and L in FIGS. 3A and 3B represent the following information. It is noted that a and b in FIGS. 3A and 3B will be described below.

T: Size of the formed image (length in the conveyance direction)

G: Interval of the inter-image region (length in the conveyance direction)

L: Distance between the primary transfer part N1 on the lowermost stream and the secondary transfer part N2

According to the present exemplary embodiment, it is determined as to which image passes through the secondary transfer part N2 (in the course of the secondary transfer) at the processing executable timing and which inter-image region is passing through. For that purpose, according to the present exemplary embodiment, a and b are calculated by Expression (1) described below.

$$(L-b)/(T+G)=a \quad \text{Expression(1)}$$

That is, at the processing executable timing, sheets of images and pieces of the inter-image regions are located between the primary transfer part N1 on the lowermost stream and the secondary transfer part N2, and it is found that a distance from the a-th inter-image region to the secondary transfer part N2 is b. Specifically, it is possible to calculate an integer part of A calculated by A=L/(T+G) as a on the basis of the above-described Expression (1) (that is, a=[A]). Then, it is possible to calculate b from this a and Expression (1). For example, the thus calculated a and b are assumed to be calculated by Expression (1).

Figure 4:
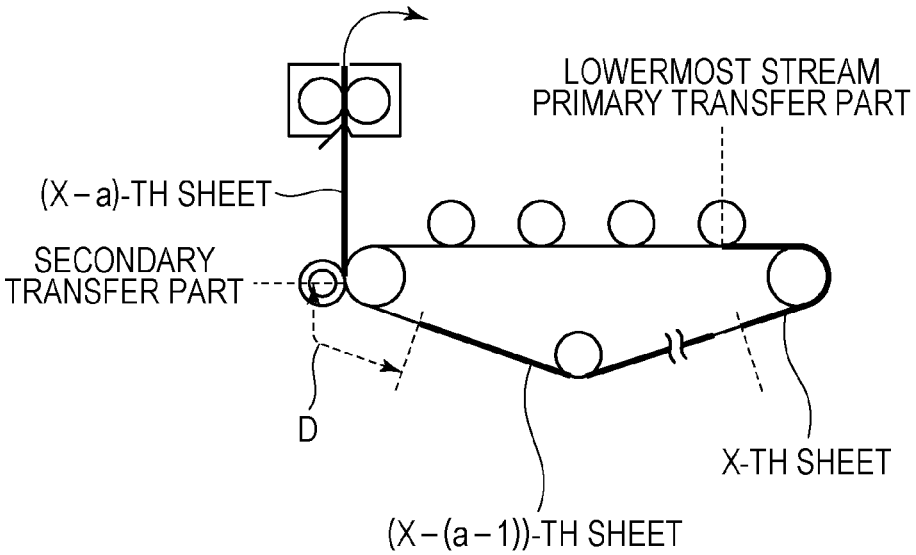
FIG. 4 is a schematic diagram illustrating another example of the image forming situation at the processing executable timing.

FIG. 4 is a cross sectional view of the image forming apparatus illustrating an example of the image forming situation at the processing executable timing (when the primary transfer of the image on the X-th sheet at the primary transfer part N1 on the lowermost stream is ended) in a case where the interval of the inter-image region is adjusted.

In the example illustrated in FIG. 4, the inter-image region corresponding to the non-image region is located at the secondary transfer part N2 at the processing executable timing. This interval of the inter-image region is set as the processing interval D which will be described below corresponding to the interval of the inter-image region after the adjustment. Accordingly, the control is executed such that the secondary transfer of the image on the (X−a)-th sheet is already ended at the time of the execution of the discharge processing, and the non-image region is located at the secondary transfer part N2. The processing interval D is a distance set while the discharge processing is taken into account. For that reason, the adjustment processing unit 216 stops the application of the voltage having the positive polarity from the transfer power source 21 and starts the application of the voltage having the negative polarity (that is, the polarity of the applied voltage is switched), so that the discharge processing can be executed. After the discharge processing is ended, the adjustment processing unit 216 also stops the application of the voltage having the negative polarity from the transfer power source 21 and starts the application of the voltage having the positive polarity (that is, the polarity of the applied voltage is switched). This is because, after the discharge processing is ended, the secondary transfer of the image on the (X−(a−1))-th sheet is performed at the secondary transfer part, and also, the primary transfer of the image on the (X+1)-th sheet resumed by the image control unit 213 is performed.

Figure 5:
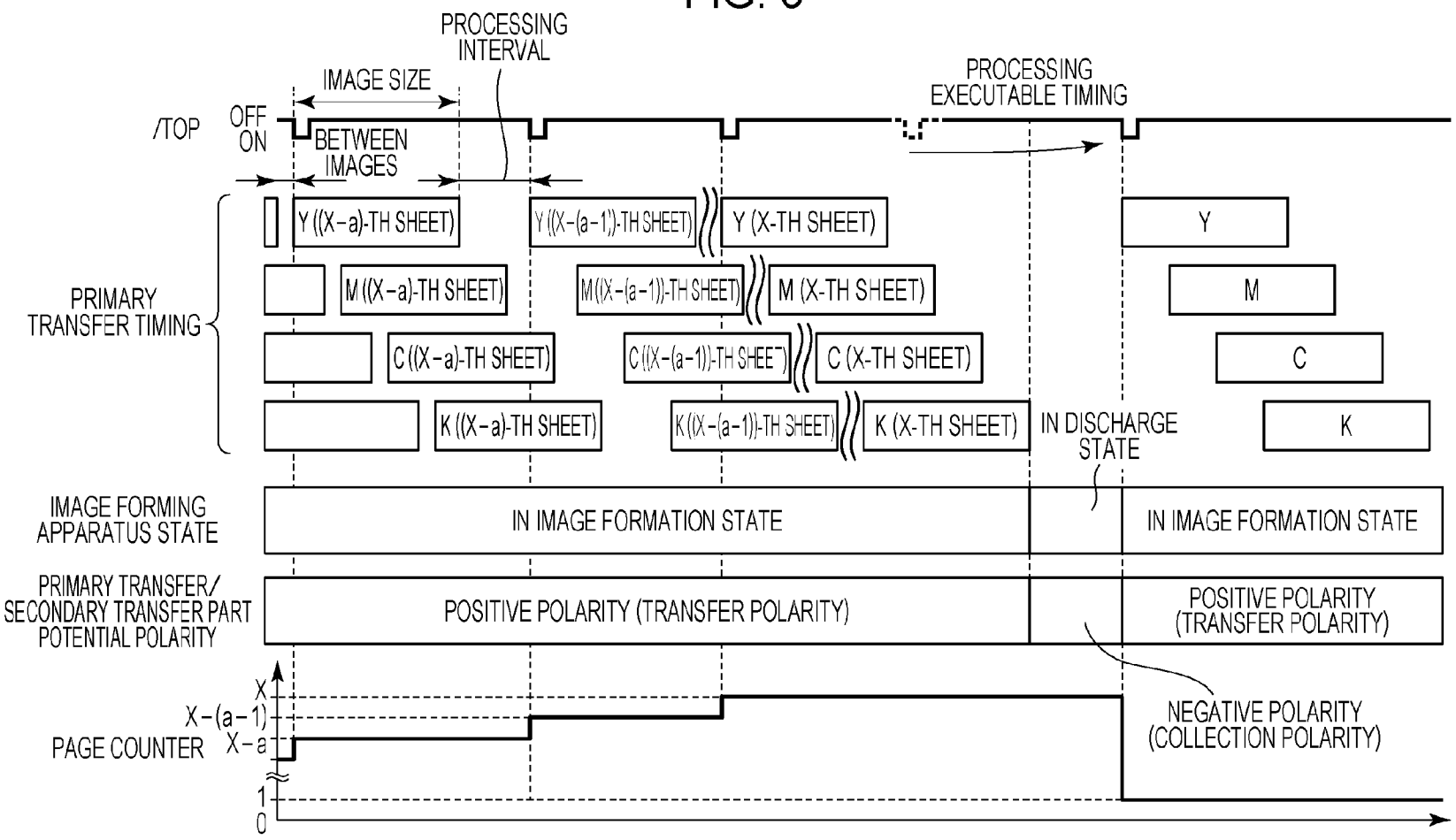
FIG. 5 is a timing chart illustrating an example of operation of executing discharge processing.

FIG. 5 is a timing chart illustrating operation by the image forming apparatus 100 in a time-series manner in the example illustrated in FIG. 4. In FIG. 5, a column of /TOP indicates the presence or absence of the /top signal from the CPU 211. A column of the primary transfer timing indicates timings at which the primary transfer is performed in the respective image forming units SY, SM, SC, and SK. A column of an image forming apparatus state indicates a state of the image forming apparatus (in the image forming processing or in the discharge processing). A column of a primary transfer/secondary transfer part potential polarity indicates the polarities of the potentials generated at the primary transfer part N1 and the secondary transfer part N2 in the respective image forming apparatus states. A column of a page counter indicates a change in the count value by the page counter 217.

When the /top signal is received from the CPU 211, the controller unit 201 outputs the video signal. The image control unit 213 starts the image formation for each color in response to this video signal. The adjustment processing unit 216 increments the count value of the page counter 217 by 1 for each image formation. The image control unit 213 performs the continuous image formation with a predetermined image size and a predetermined inter-image region. When a notification indicating that the count value of the page counter 217 becomes X−(a−1) sheets in the next image formation is received from the adjustment processing unit 216, the image control unit 213 then performs the next image formation by setting the interval of the inter-image region between the (X−a)-th sheet and the (X−(a−1))-th sheet as the processing interval D. When a notification indicating that the count value of the page counter 217 becomes X sheets is received from the adjustment processing unit 216, the CPU 211 does not output the /top signal which has been expected to be output after the X-th sheet (a broken line section in FIG. 5). Accordingly, the image formation in the image control unit 213 is temporarily interrupted to prepare for the discharge processing. Since the discharge processing is executed by setting the polarity of the potential generated at the primary transfer part N1 as the polarity opposite to the polarity upon the image formation, the discharge processing can be executed at a time subsequent to the timing at which at least the primary transfer of the currently formed image is ended. This timing is the processing executable timing.

When the processing executable timing arrives, the adjustment processing unit 216 stops the application of the voltage having the positive polarity from the transfer power source 21 and starts the application of the voltage having the negative polarity. According to the present exemplary embodiment, the voltage having the negative polarity to be applied at this time is, for example, set as −1000 V. Accordingly, the potential generated at the primary transfer part N1, in more detail, the potential on the intermediate transfer belt 10 at the primary transfer part N1 is maintained, for example, at −300 V. The adjustment processing unit 216 exposes the photosensitive drum 1 by the exposure apparatus 3 almost at the same time as the timing of switching the polarity of the applied voltage from the transfer power source 21 and develops the photosensitive drum 1 by the developing apparatus 4, so that the discharge toner image is formed on the photosensitive drum 1. According to the present exemplary embodiment, the discharge toner images are formed almost at the same time by the first, second, third, and fourth image forming units SY, SM, SC, and SK. The discharge toner image formed of the toner having the negative polarity is withheld on the photosensitive drum 1 by the potential difference formed at the primary transfer part N1 and is then collected into the collection container 52 by the cleaning blade 51. Thereafter, the adjustment processing unit 216 clears the count value of the page counter 217 to 0, stops the application of the voltage having the negative polarity from the transfer power source 21, and starts the application of the voltage having the positive polarity. Subsequently, the image formation (primary transfer) is resumed in the image control unit 213.

Figure 6:
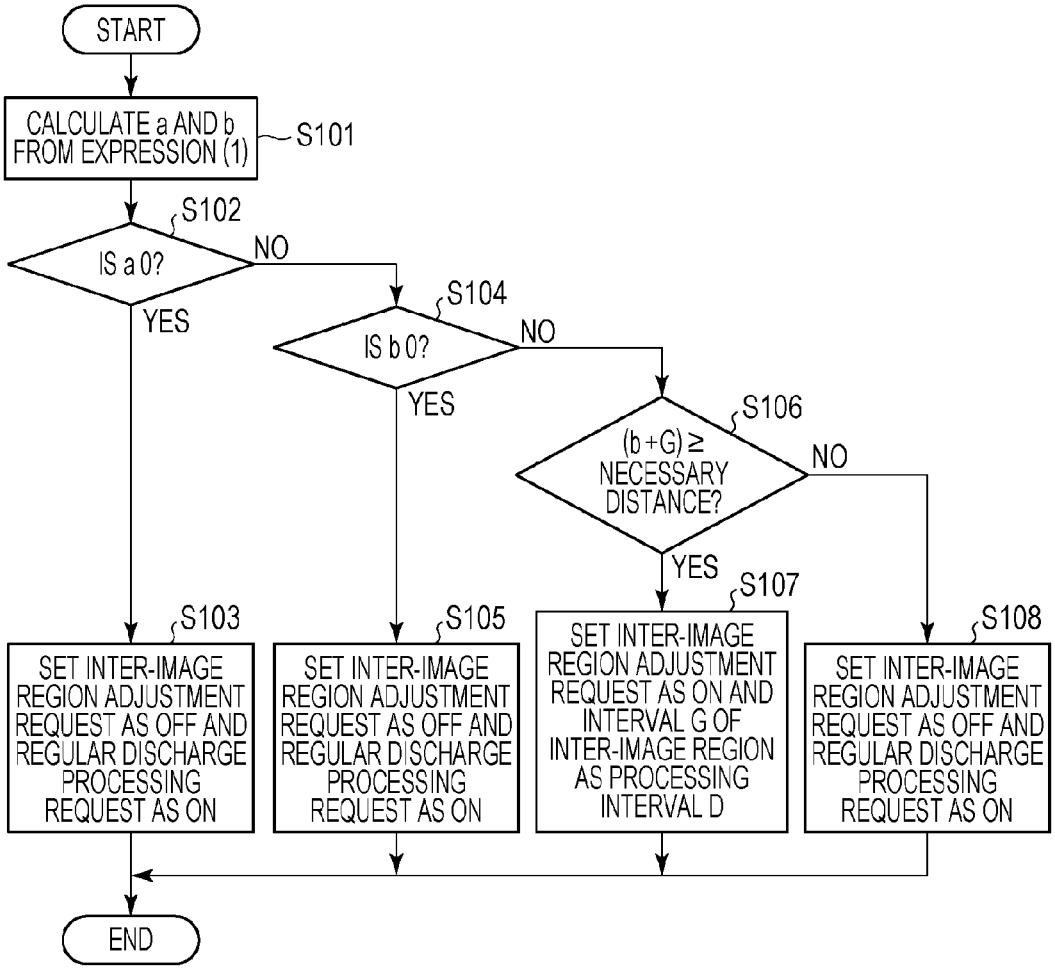
FIG. 6 is a flow chart illustrating an example of processing such as necessity determination on an adjustment for an interval of an inter-image region.
Figure 7A:
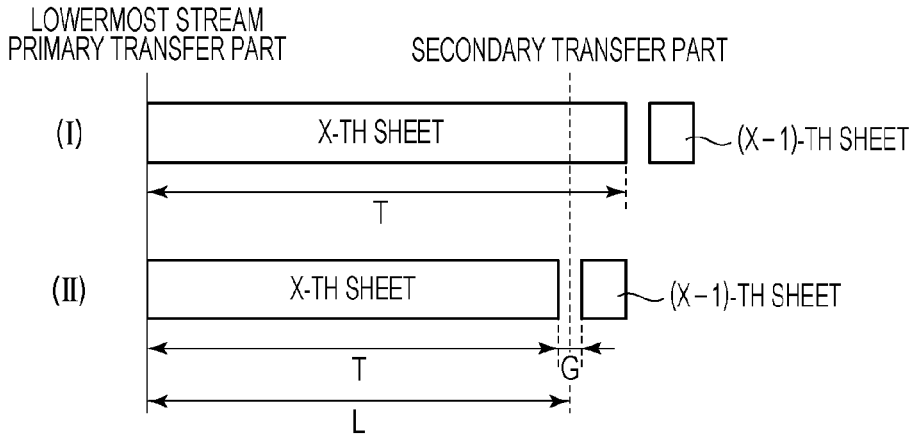
FIGS. 7A, 7B, and 7C are schematic diagrams for describing a technique for the necessity determination on the adjustment for the interval of the inter-image region.
Figure 7B:
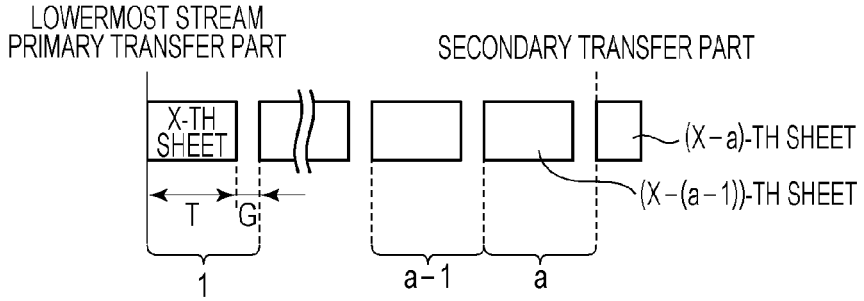
Figure 7C:
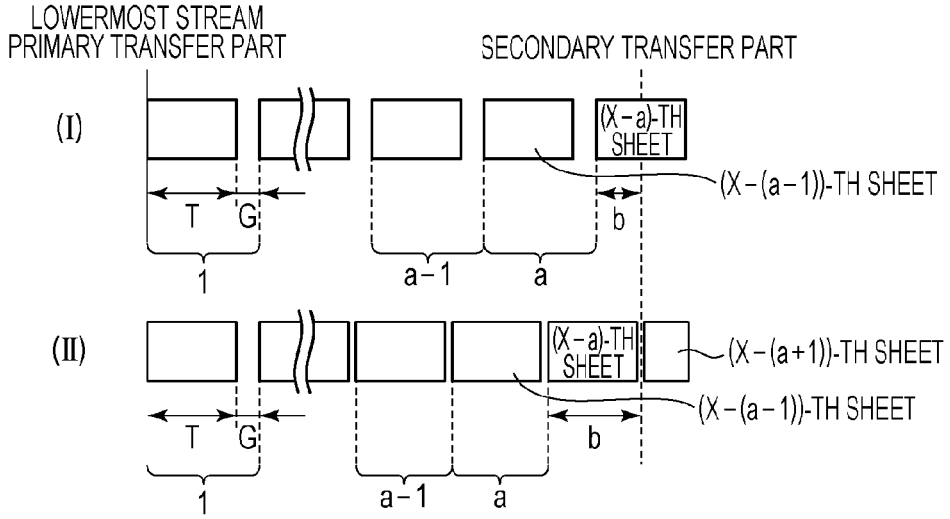

FIG. 6 is a flow chart for the processing of determining the necessity of the adjustment for the interval of the inter-image region, the position of the inter-image region where the interval is adjusted, the interval to be adjusted, and the like. FIGS. 7A, 7B, and 7C are schematic diagrams illustrating the image forming position on the intermediate transfer belt 10 determined in the processing of FIG. 6. It is noted that the processing of FIG. 6 is performed by the adjustment processing unit 216.

In S101, a and b are calculated by Expression (1) described above. This a calculated here indicates the position of the inter-image region to which the processing interval D is applied. This b calculated here is applied to the value of the processing interval D that is applied to the inter-image region at the position indicated by a.

In S102, it is determined whether or not the value a calculated by Expression (1) is 0. In S102, when it is determined that a is 0, the flow proceeds to the processing in S103. FIG. 7A illustrates an example of the image forming situation in a case where a is 0. When a is 0, two cases are conceivable including a case where none of the image size T and the inter-image region G exist in the distance L between the primary transfer part N1 on the lowermost stream and the secondary transfer part N2 (I in FIG. 7A) and a case where only the image size T exists (II in FIG. 7A). In the case of I in FIG. 7A, the secondary transfer of the image on the X-th sheet is already performed. In the case of II in FIG. 7A, the inter-image region between the X-th sheet and the (X−1)-th sheet is passing through the secondary transfer part N2. As described above, since the productivity is normally increased by setting the inter-image region to be the short distance as much as possible, a necessary distance which will be described below for performing the discharge processing (hereinafter, will be also referred to as "necessary distance") cannot be secured. Therefore, in S102, when it is determined that a is 0, the discharge processing stands by and is then performed after the image on the X-th sheet passes through the secondary transfer part N2. For that reason, in S103, a regular discharge processing request is set as ON, and an inter-image region adjustment request is set as OFF.

In S102, when it is determined that a is not 0, the flow proceeds to the processing in S104. In S104, it is determined whether or not the value b calculated by Expression (1) is 0. In S104, when it is determined that b is 0, the flow proceeds to the processing in S105. FIG. 7B illustrates an example of the image forming situation in a case where b is 0. When b is 0, a case is conceivable where a pieces each of the image sizes T and the inter-image regions G exist in the distance L between the primary transfer part N1 on the lowermost stream and the secondary transfer part N2, and the leading end of the a-th inter-image region has just reached the secondary transfer part N2. In this case too, similarly as in the case of FIG. 7A, since the necessary distance cannot be secured in the normal inter-image region, the discharge processing stands by and is then performed after the image on the X-th sheet passes through the secondary transfer part N2. For that reason, in S105, the regular discharge processing request is set as ON, and the inter-image region adjustment request is set as OFF.

In S104, when it is determined that b is not 0, the flow proceeds to the processing in S106. FIG. 7C illustrates an image forming situation in a case where b is not 0. When b is not 0, two cases are conceivable including a case where the secondary transfer of the image on the (X−a)-th sheet is performed at the secondary transfer part N2 (I in FIG. 7C) and a case where the inter-image region between the (X−a)-th sheet and the (X−(a+1))-th sheet passes through the secondary transfer part N2 (II in FIG. 7C). In this case, in S106, it is determined whether or not the inter-image region G+b is higher than or equal to the necessary distance.

Herein, the necessary distance refers to a required minimum distance when the discharge processing is performed. The necessary distance is determined on the basis of a time used for switching the polarities of the potentials generated at the primary transfer part N1 and the secondary transfer part N2 by the transfer power source 21 and a width in the conveyance direction of the discharge toner image. That is, the necessary distance (denoted by E in the following description) is calculated by Expression (2) described below.

Necessary Distance=((The time used for switching the polarity from the positive polarity to the negative polarity+The time used for switching the polarity from the negative polarity to the positive polarity)×The process speed)+The width of the discharge toner image — Expression (2)

In S106, when it is determined that the inter-image region G+b is higher than or equal to the necessary distance, in S107, the interval of the inter-image region G between the (X−a)-th sheet and the (X−(a−1))-th sheet is set as the processing interval D, and the inter-image region adjustment request is set as ON. Accordingly, the discharge processing can be immediately executed at the processing executable timing.

Herein, the processing interval D is calculated by Expression (3) described below.

The processing interval *D*=The inter-image region *G+b* calculated by Expression (1) — Expression (3)

In S106, when it is determined that the inter-image region G+b is lower than the necessary distance, the necessary distance cannot be secured even when the processing interval D is applied. Therefore, the discharge processing stands by and is then performed after the image on the X-th sheet passes through the secondary transfer part N2. For that reason, in S108, the regular discharge processing request is set as ON, and the inter-image region adjustment request is set as OFF.

In this manner, according to the present exemplary embodiment, the adjustment is performed to expand the interval of the inter-image region that reaches the secondary transfer part N2 ahead of the image at the primary transfer part N1 immediately before the processing executable timing, and while the adjustment processing is executed, the inter-image region is located at the secondary transfer part N2. This control is performed by the engine control 202 functioning as an example of a control unit that executes the adjustment processing. Herein, the position of the inter-image region where the adjustment is performed and the interval after the adjustment are determined on the basis of the size of the images that are to be at least partially located between the primary transfer part N1 and the secondary transfer part N2 at the processing executable timing and the interval of the inter-image region between the images in a case where the adjustment is not performed. Subsequently, as described above, the interval of the inter-image region between the images located at the secondary transfer part N2 or located immediately before the secondary transfer part N2 and the image that reaches the secondary transfer part N2 subsequent to the above-described image is adjusted at the processing executable timing.

Figure 8:
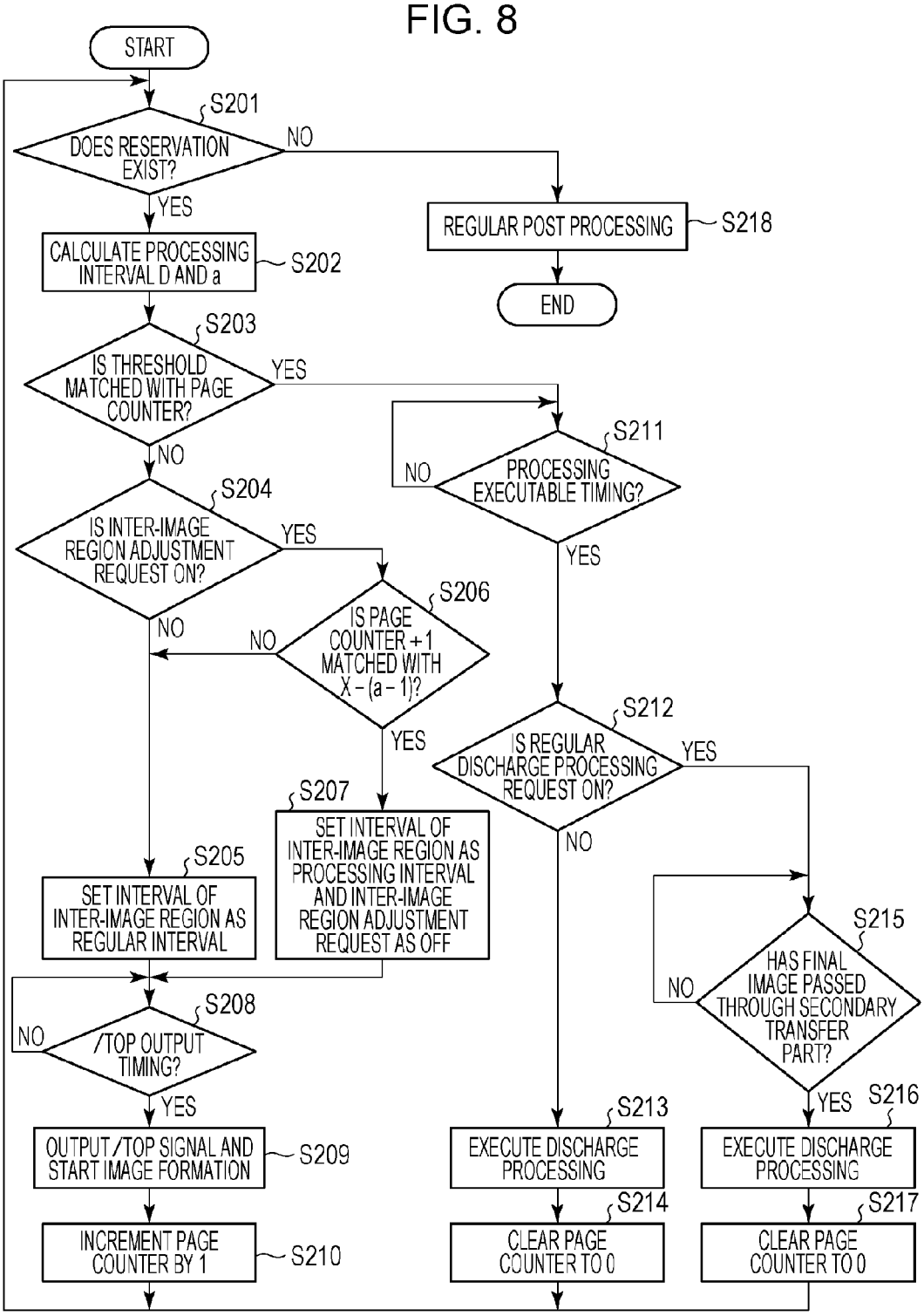
FIG. 8 is a flow chart illustrating an example of discharge processing.

FIG. 8 is a flow chart of the discharge processing according to the present exemplary embodiment. This flow chart can be applied to the second and subsequent sheets for the continuous image formation.

In S201, the CPU 211 determines whether or not the print reservation from the controller unit 201 exists. When it is determined that the print reservation does not exist, in S218, the CPU 211 executes the regular post processing and ends the image formation.

In S201, in a case where the CPU 211 determines that the print reservation exists, in S202, the adjustment processing unit 216 calculates the above-described processing interval D and the information a that is necessary for the application of the processing interval D.

In S203, the adjustment processing unit 216 compares the predetermined threshold corresponding to the processing execution condition with the count value of the page counter 217. In a case where the adjustment processing unit 216 determines in S203 that the count value of the page counter 217 is not matched with the predetermined threshold, that is, that the count value of the page counter 217 is not X sheets, the flow proceeds to the processing S204.

In S204, the adjustment processing unit 216 determines whether or not the above-described inter-image region adjustment request exists (ON or OFF). When it is determined that the inter-image region adjustment request is ON, the interval of the inter-image region is adjusted in a manner that will be described below, and the discharge processing is performed. In a case where the adjustment processing unit 216 determines in S204 that the inter-image region adjustment request is OFF, in S205, the image formation continues at the regular interval of the inter-image region.

When the adjustment processing unit 216 determines in S204 that the inter-image region adjustment request is ON, in S206, the count value of the page counter 217 is checked. In a case where the adjustment for the interval of the inter-image region is performed, in S202, the position of the inter-image region where the interval is adjusted is between the (X−a)-th sheet and the (X−(a−1))-th sheet on the basis of a calculated by Expression (1). Therefore, in S206, the adjustment processing unit 216 determines whether or not the next image formation is the (X−(a−1))-th sheet. Subsequently, in a case where the adjustment processing unit 216 determines in S206 that the next image formation is the (X−(a−1))-th sheet, the flow proceeds to the processing in S207. In S207, the image formation is performed by setting the interval of the inter-image region between the (X−a)-th sheet and the (X−(a−1))-th sheet as the processing interval D calculated in S202, and the inter-image region adjustment request is set as OFF. In a case where the adjustment processing unit 216 determines in S206 that the next image formation is not the (X−(a−1))-th sheet, in S205, the image formation is performed at the regular interval of the inter-image region.

Thereafter, in S208, the CPU 211 determines whether or not a timing for outputting the /top signal (/TOP output timing) has arrived. The /TOP output timing is determined on the basis of the image size (conveyance direction length) and the interval of the inter-image region determined in S205 or S207. When it is determined in S208 that the /TOP output timing has arrived, in S209, the CPU 211 outputs the /top signal to the controller unit 201 and receives the video signal for the next image formation to perform the image formation. Thereafter, in S210, the adjustment processing unit 216 increments the count value of the page counter 217 by 1 and returns to the determination in S201.

In a case where the adjustment processing unit 216 determines in S203 that the count value of the page counter 217 is matched with the predetermined threshold, that is, that the count value of the page counter 217 is X sheets, the image formation is temporarily interrupted to prepare for the discharge processing. Subsequently, in S211, the adjustment processing unit 216 determines whether or not the processing executable timing, that is, the timing at which the primary transfer of the image on the X-th sheet is ended has arrived.

When it is determined in S211 that the processing executable timing has arrives, in S212, the adjustment processing unit 216 determines whether or not the above-described regular discharge processing request exists (ON or OFF). In a case where the adjustment processing unit 216 determines in S212 that the regular discharge processing request is OFF, the flow proceeds to S213. In S213, when the processing executable timing has arrived, the application of the voltage having the positive polarity from the transfer power source 21 is immediately stopped, and the application of the voltage having the negative polarity is started, so that the discharge processing is performed. In this case, this is because the non-image region where the secondary transfer is not performed is located at the secondary transfer part N2 at the processing executable timing with the application of the processing interval D. It is noted that, after the discharge processing is ended, the adjustment processing unit 216 stops the application of the voltage having the negative polarity from the transfer power source 21 in preparation for the secondary transfer processing and starts the application of the voltage having the positive polarity. Thereafter, the adjustment processing unit 216 clears the count value of the page counter 217 to 0 in S214.

In a case where the adjustment processing unit 216 determines in S212 that the regular discharge processing request is ON, in S215, the adjustment processing unit 216 stands by until the image on the X-th sheet passes through the secondary transfer part N2. When the adjustment processing unit 216 detects in S215 that the image on the X-th sheet passes through the secondary transfer part N2, the discharge processing is performed at this timing similarly as in S213 (S216), and thereafter, the count value of the page counter 217 is cleared to 0 (S217).

6. Advantages

Next, a time until when the image formation is resumed is compared in a case where the discharge processing is performed after the passage of the image on the X-th sheet through the secondary transfer part without adjusting the interval of the inter-image region (comparison example) and a case where the discharge processing is performed by adjusting the interval of the inter-image region (the present exemplary embodiment). As an example, various dimensions related to the image forming situation is defined as follows.

The length L from the primary transfer part N1 on the lowermost stream to the secondary transfer part N2: 390 mm The size T of the formed image (conveyance direction length): 279.4 mm The interval G of the inter-image region (length in the conveyance direction): 35 mm z: 70 mm In this case, a and b are calculated by Expression (1) as follows.

a=1 b=75.6 mm

According to the determination in S106 in FIG. 6, a relationship of b+G=75.6+35=110.6 mm≥70 mm=E is established. In S107 in FIG. 6, the processing interval D is calculated as 110.6 mm. That is, according to the present exemplary embodiment, D (=b+G) is lower than L. From a=1, the processing interval D is applied to the inter-image region between the X-th sheet and the (X−1)-th sheet.

Figure 9:
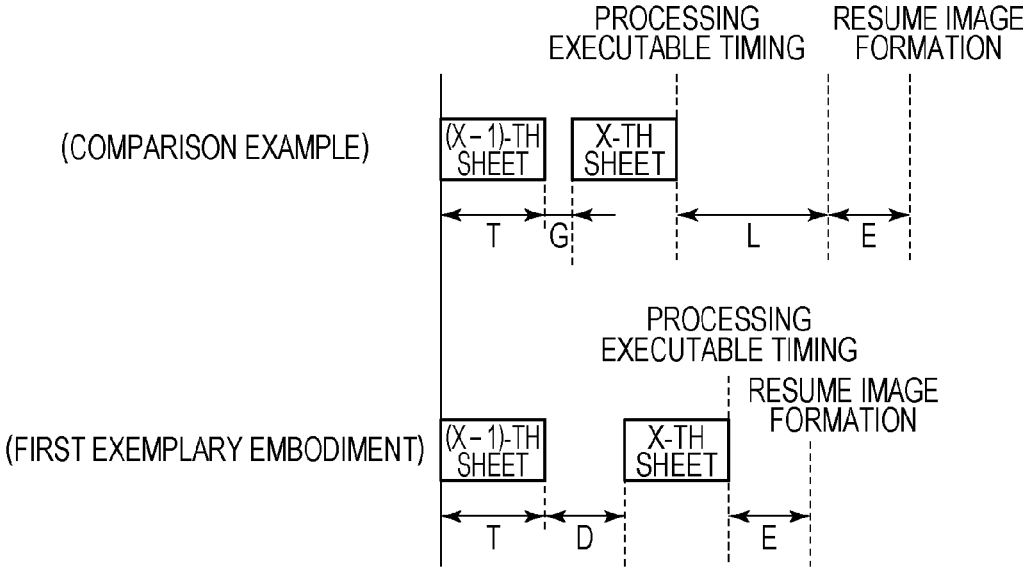
FIG. 9 is a schematic diagram illustrating advantages of an exemplary embodiment of the present invention.

FIG. 9 is a timing chart illustrating timings at which the image formation is resumed after the discharge processing according to a comparison example and the present exemplary embodiment. From FIG. 9, in a case where the discharge processing is performed without the adjustment for the interval of the inter-image region as in the comparison example, the distance to the resumption of the image formation which is calculated from the trailing end of the image on the (X−1)-th sheet is as follows.

$$G+T+L+E=35\text{ mm}+279.4\text{ mm}+390\text{ mm}+70\text{ mm}=774.4\text{ mm}$$

On the other hand, in a case where the discharge processing is executed by adjusting the interval of the inter-image region as in the present exemplary embodiment, the distance to the resumption of the image formation which is calculated from the trailing end of the image on the (X−1)-th sheet is as follows.

$$D+T+E=110.6\text{ mm}+279.4\text{ mm}+70\text{ mm}=460\text{ mm}$$

In this manner, according to the present exemplary embodiment, the timing for starting the image formation after the discharge processing is ended can be advanced by an amount equivalent to 314.4 mm as compared with the comparison example.

As described above, according to the present exemplary embodiment, in the configuration where the polarities of the potentials generated at the primary transfer part N1 and the secondary transfer part N2 cannot be independently controlled, the polarity of the potential generated at the primary transfer part N1 for the adjustment processing is set as a different polarity from that upon the image formation. In this case, the interval of the inter-image region is adjusted such that the polarity of the potential generated at the secondary transfer part N2 can be switched at a timing for switching the polarity of the potential generated at the primary transfer part N1. Accordingly, the resumption of the image formation is advanced after the adjustment processing, and it is possible to suppress the decrease in the productivity.

Second Exemplary Embodiment

Next, another exemplary embodiment of the present invention will be described. The basic configuration and operation of the image forming apparatus according to the present exemplary embodiment is similar to those according to the first exemplary embodiment. Therefore, elements having the same or equivalent functions and configuration as those according to the first exemplary embodiment are assigned with the same reference symbols, and detailed descriptions thereof will be omitted.

1. Adjustment for Interval of Inter-Image Region

According to the first exemplary embodiment, the control is performed such that the inter-image region corresponding to the non-image region is located at the secondary transfer part N2 at the processing executable timing. In this case, the discharge processing can be immediately executed at the processing executable timing has arrived. However, in this case, the processing interval D applied to the inter-image region may be substantially large with respect to the necessary distance described in the first exemplary embodiment depending on the size of the formed image. As a result, a timing for forming the image subsequent to the inter-image region to which the processing interval D is applied may be delayed in some cases.

In contrast to this, according to the present exemplary embodiment, the productivity before the adjustment processing is executed is improved by setting the processing interval D as the necessary distance described in the first exemplary embodiment. That is, according to the first exemplary embodiment, the inter-image region where the interval is adjusted reaches the secondary transfer part N2 at the processing executable timing, and in order that the interval of the inter-image region which is at least sufficient for executing the adjustment processing is secured, the position of the relevant inter-image region and the interval after the above-described adjustment are determined. In contrast to this, according to the present exemplary embodiment, the inter-image region where the interval is adjusted reaches the secondary transfer part N2 after the processing executable timing, and in order that the interval of the inter-image region sufficient to execute the adjustment processing is secured, the position of the relevant inter-image region and the interval after the above-described adjustment are determined.

Figure 10:
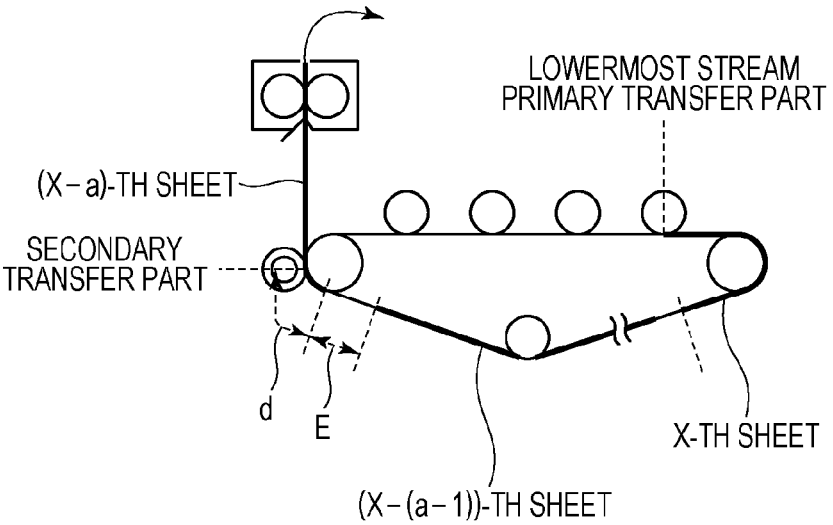
FIG. 10 is a schematic diagram illustrating another example of the image forming situation at the processing executable timing.

FIG. 10 is a cross sectional view of the image forming apparatus, illustrating an example of the image forming situation at the processing executable timing (when the primary transfer of the image on the X-th sheet at the primary transfer part N1 on the lowermost stream is ended) in a case where the interval of the inter-image region is expanded by a necessary distance E.

As illustrated in FIG. 10, as is different from the case of the first exemplary embodiment illustrated in FIG. 4, the secondary transfer of the image on the (X−a)-th sheet is performed at the processing executable timing. According to the present exemplary embodiment, the interval of the inter-image region between the (X−a)-th sheet and the (X−(a−1))-th sheet is set as the necessary distance E instead of the processing interval D applied in the first exemplary embodiment. In addition, the discharge processing is executed after an elapse of a predetermined period of time since the processing executable timing has arrived. In the example illustrated in FIG. 10, the discharge processing is executed after an elapse of a section (time) (hereinafter, will be also referred to as "passage waiting section") d from the processing executable timing until when the trailing end of the image on the (X−a)-th sheet completes to pass through the secondary transfer part N2. Accordingly, the inter-image region that secures the necessary distance E passes through the secondary transfer part N2 at the time of the execution of the discharge processing.

Figure 11:
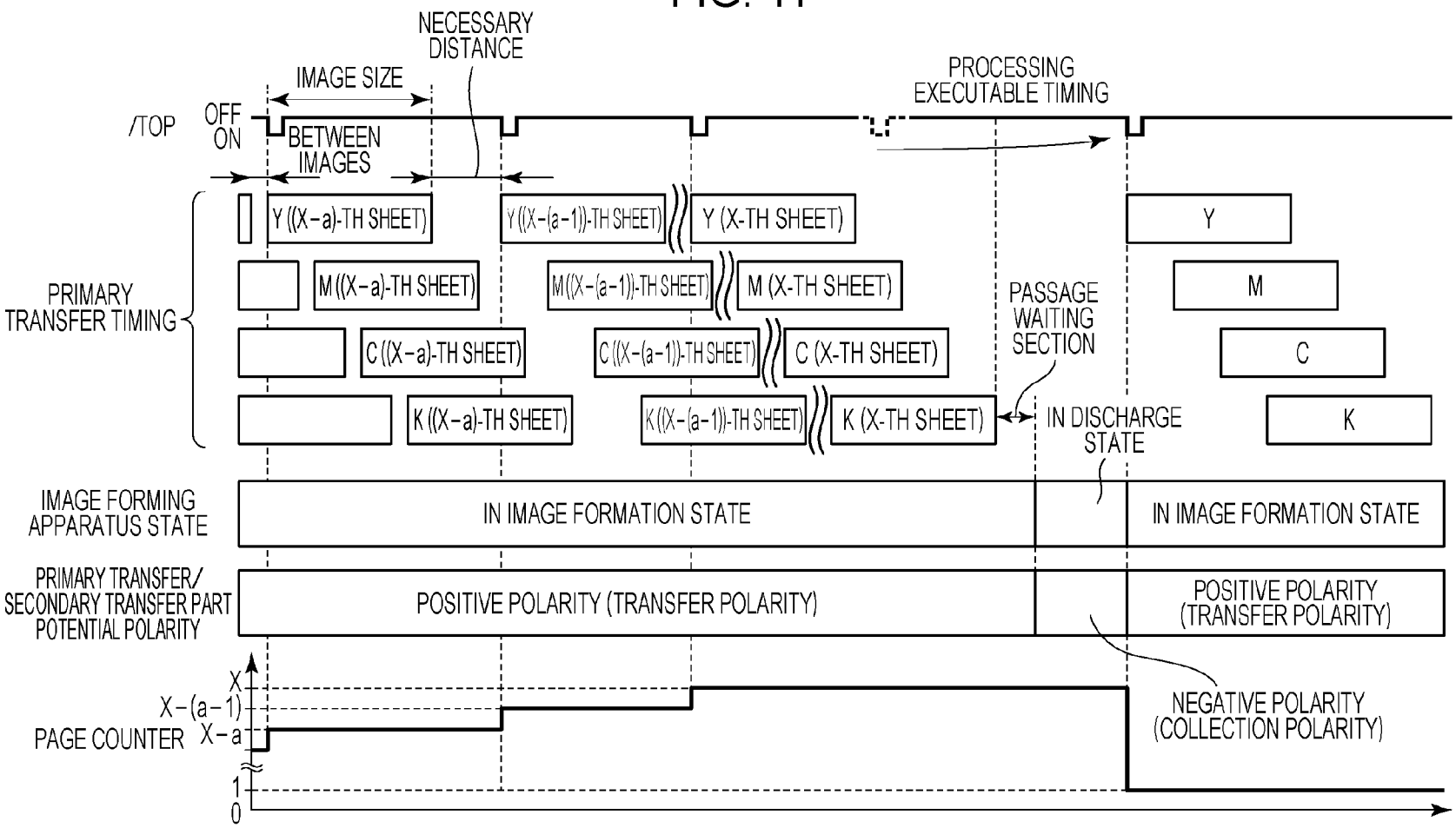
FIG. 11 is a timing chart illustrating another example of operation of executing the discharge processing.

FIG. 11 is a timing chart illustrating the operation by the image forming apparatus 100 in a time-series manner in the example illustrated in FIG. 10. Respective columns in FIG. 11 represent the similar columns in FIG. 5. In the time chart of FIG. 11, descriptions on similar parts to those in the time chart of FIG. 5 described in the first exemplary embodiment are omitted, and different parts will be described.

According to the present exemplary embodiment, when a notification indicating that the count value of the page counter 217 becomes X−(a−1) sheets in the next image formation is received from the adjustment processing unit 216, the image control unit 213 performs the next image formation by setting the interval of the inter-image region between the (X−a)-th sheet and the (X−(a−1))-th sheet as the necessary distance E. When a notification indicating that the count value of the page counter 217 becomes X sheets is received from the adjustment processing unit 216, the CPU 211 does not output the /top signal expected to be output after the X-th sheets (broken line part in FIG. 11). Accordingly, the image formation in the image control unit 213 is temporarily interrupted to prepare for the discharge processing.

According to the present exemplary embodiment, the adjustment processing unit 216 waits for the elapse of the passage waiting section after the processing executable timing has arrived. Then, after the passage waiting section has elapsed, the adjustment processing unit 216 stops the application of the voltage having the positive polarity from the transfer power source 21 and starts the application of the voltage having the negative polarity, so that the discharge processing is executed similarly as in the case of the first exemplary embodiment. A calculation method for the passage waiting section will be described below.

Figure 12:
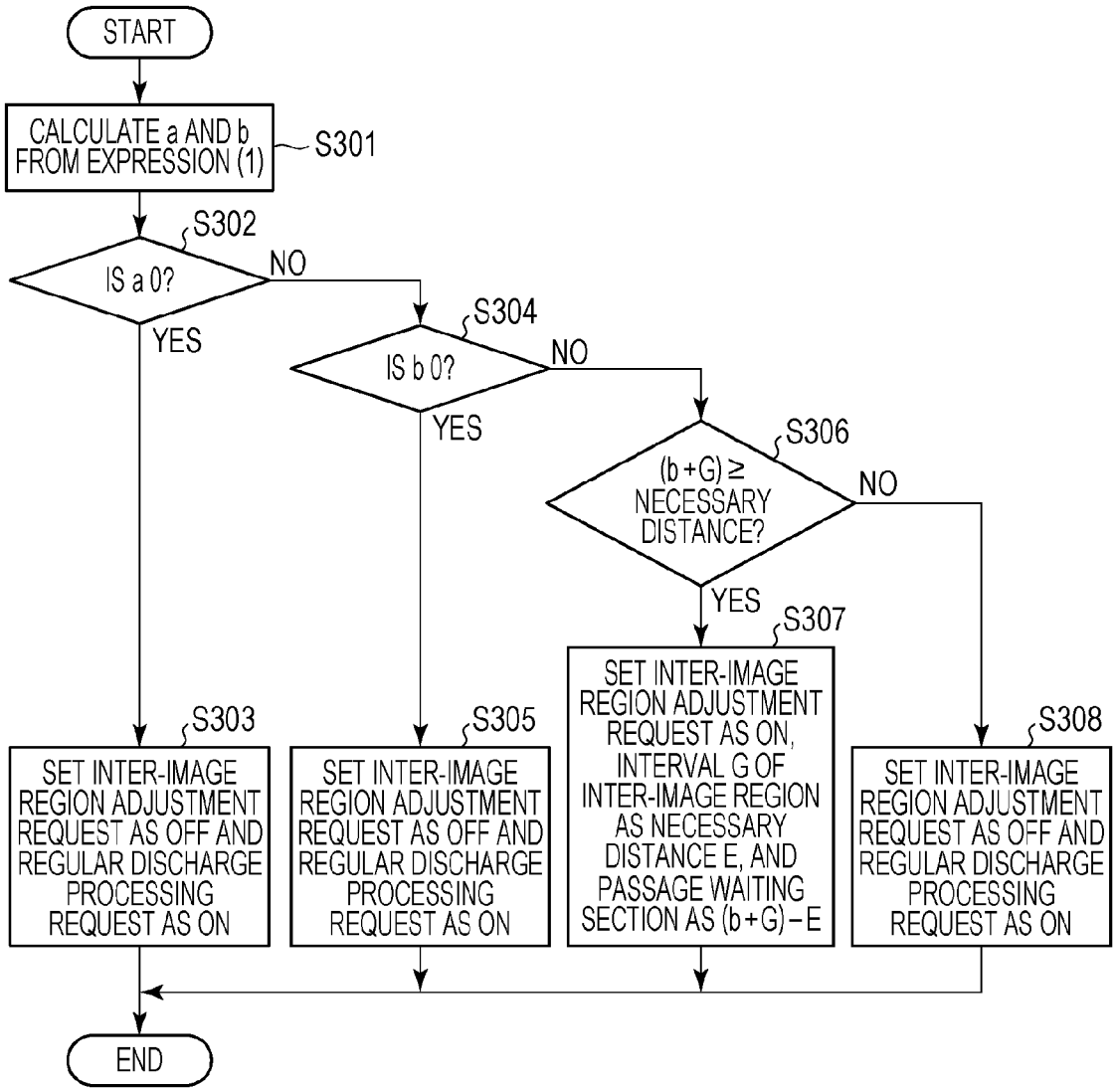
FIG. 12 is a flow chart illustrating another example of the processing such as the necessity determination on the adjustment for the interval of the inter-image region.

FIG. 12 is a flow chart for a control on the processing of determining the necessity of the adjustment for the interval of the inter-image region, the position of the inter-image region where the interval is adjusted, the interval to be adjusted, and the like. It is noted that the processing of FIG. 12 is performed by the adjustment processing unit 216. In the flow chart of FIG. 12, descriptions on parts similar to those in the flow chart of FIG. 6 described in the first exemplary embodiment are omitted, and different parts will be described.

Processes in S301 to S306 in FIG. 12 are similar to the processes in S101 to S106 in FIG. 6.

According to the present exemplary embodiment, in S306, when it is determined that the inter-image region G+b is higher than or equal to the necessary distance E, in S307, the inter-image region G between the (X−a)-th sheet and the (X−(a−1))-th sheet is set as the necessary distance E, and the inter-image region adjustment request is set as ON. In addition, according to the present exemplary embodiment, as is different from the first exemplary embodiment, the discharge processing cannot be immediately executed at the processing executable timing. According to the present exemplary embodiment, it is possible to execute the discharge processing after the above-described passage waiting section elapses. Therefore, according to the present exemplary embodiment, in S307, the passage waiting section is calculated by Expression (4) described below.

$$d=(b+G)-E \qquad \text{(Expression(4))}$$

In S306, when it is determined that the inter-image region G+b is lower than the necessary distance, the flow proceeds to the processing S308. The processing in S308 is similar to the processing in S108 in FIG. 6.

Figure 13:
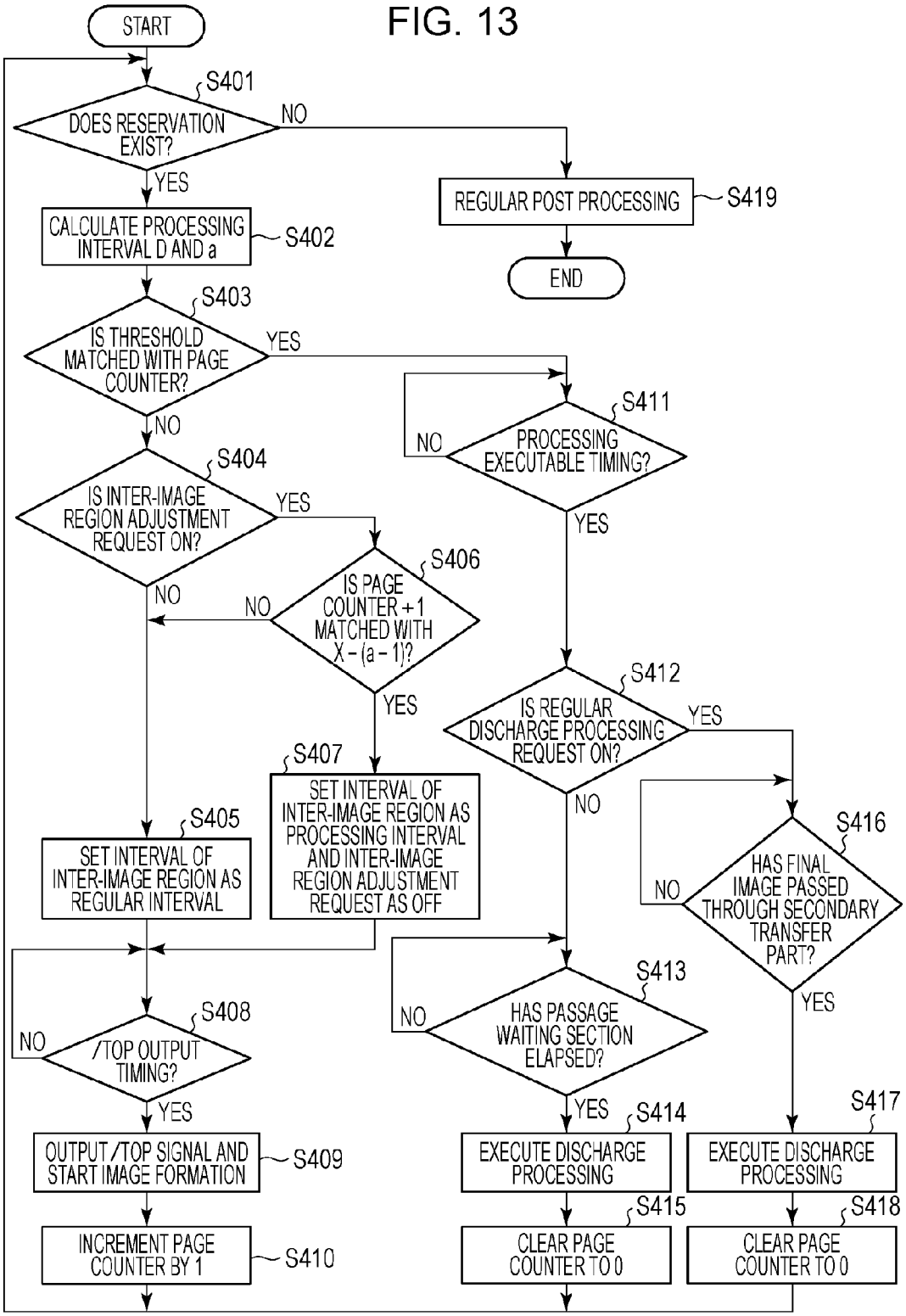
FIG. 13 is a flow chart illustrating another example of the discharge processing.

FIG. 13 is a flow chart for the discharge processing according to the present exemplary embodiment. It is noted that this flow chart can be applied to the second and subsequent sheets for the continuous image formation. In the flow chart of FIG. 13, descriptions on parts similar to the flow chart of FIG. 8 described in the first exemplary embodiment are omitted, and different parts will be described.

Processes in S401 to S412 in FIG. 13 are similar to the processes in S201 to S212 in FIG. 8.

When the adjustment processing unit 216 determines in S412 that the regular discharge processing request is set as OFF, since the interval of the inter-image region is adjusted, and also the request for performing the discharge processing exists, the flow proceeds to the processing S413. In S413, the adjustment processing unit 216 waits for the elapse of the passage waiting section calculated by Expression (4). In S413, when the adjustment processing unit 216 determines that the passage waiting section has elapsed, the discharge processing is performed similarly as in the first exemplary embodiment (S414), and the count value of the page counter 217 is cleared to 0 (S415).

Processes in S416 to S419 are similar to the processes in S215 to S218 in FIG. 8.

2. Advantages

Next, the timings for forming the image on the X-th sheet according to the first exemplary embodiment and the present exemplary embodiment are compared with each other. As an example, various dimensions related to the image forming situation are defined as follows.

The length L from the primary transfer part N1 on the lowermost stream to the secondary transfer part N2: 390 mm The size T of the formed image (conveyance direction length): 279.4 mm The interval G of the inter-image region (length in the conveyance direction): 35 mm The necessary distance E: 70 mm The processing interval D according to the first exemplary embodiment: 110.6 mm In this case, in S307 in FIG. 12, the passage waiting section is calculated as follows.

$$\text{The passage waiting section}=(110.6-70)\text{ mm}=40.6\text{ mm}$$

It is noted that a=1 and b=75.6 mm are set similarly as in the first exemplary embodiment.

Figure 14:
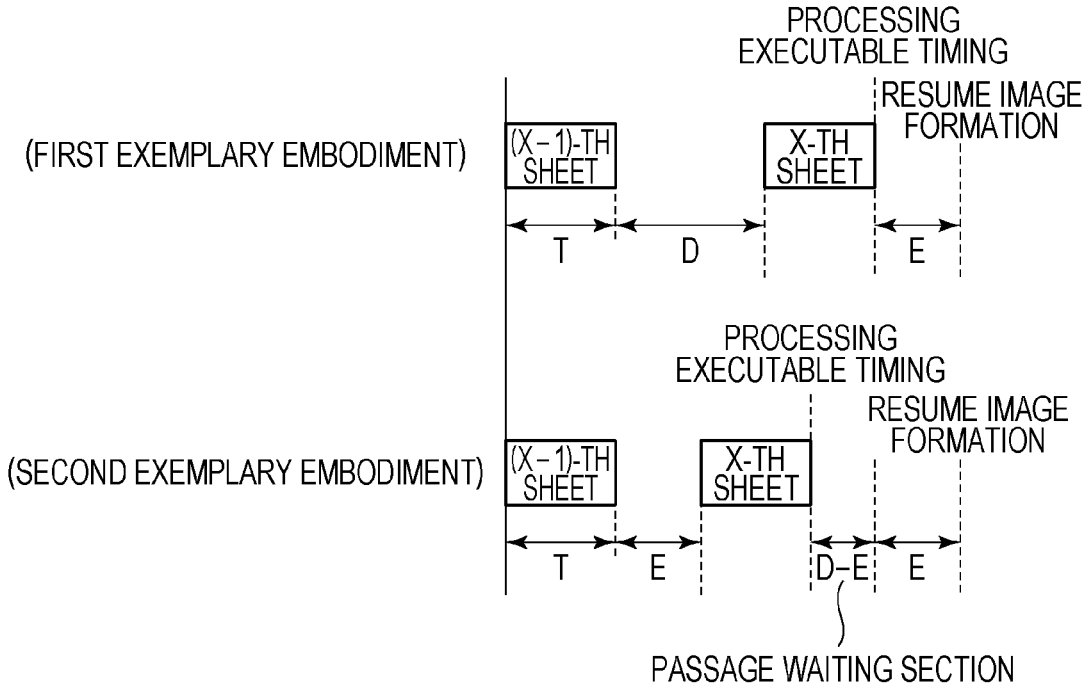
FIG. 14 is a schematic diagram illustrating advantages of another exemplary embodiment of the present invention the present invention.

FIG. 14 is a timing chart illustrating timings for a period until when the discharge processing is executed and the image formation is resumed according to the first exemplary embodiment and the present exemplary embodiment. It is found from FIG. 14 that the timing at which the image on the X-th sheet is formed according to the present exemplary embodiment is advanced by D−E which will be described below as compared with the first exemplary embodiment.

$$D-E=110.6\text{ mm}-70\text{ mm}=40.6\text{ mm}$$

It is noted that as may be understood from FIG. 14, the timing for resuming the image formation of the X-th sheet and subsequent sheets is not different from that of the first exemplary embodiment.

As described above, according to the present exemplary embodiment, the interval of the inter-image region is adjusted to the interval necessary for the adjustment processing such that the polarity of the potential generated at the secondary transfer part N2 can be switched in a time subsequent to the timing of switching the polarity of the potential generated at the primary transfer part N1 for the adjustment processing. Accordingly, an advantage similar to the first exemplary embodiment can be attained, and also the end timing for the image formation before the adjustment processing is executed can be advanced, so that it is possible to improve the productivity at a time before the adjustment processing is executed.

Third Exemplary Embodiment

Next, another exemplary embodiment of the present invention will be described. The basic configuration and operation of the image forming apparatus according to the present exemplary embodiment is similar to those according to the first exemplary embodiment. Therefore, elements having the same or equivalent functions and configuration as those according to the first exemplary embodiment are assigned with the same reference symbols, and detailed descriptions thereof will be omitted.

According to the first and second exemplary embodiments, to improve the productivity, the case has been described in which the control is performed to shorten the normal distance of the inter-image region as much as possible. In this case, as described in the first and second exemplary embodiments, the sufficient distance for performing the discharge processing cannot be secured by the normal interval of the inter-image region. In view of the above, as described in the first and second exemplary embodiments, the interval of the inter-image region is adjusted.

However, for example, in a case where a temperature rise in an end part of the fixing unit or the like occurs while the sheet that is short in the main scanning direction is conveyed, to suppress a damage to the image forming apparatus or the like, the interval of the inter-image region may be expanded as compared with the normal interval of the inter-image region in some cases.

According to the present exemplary embodiment, in the above-described situation, in a case where the interval of the inter-image region which is longer than or equal to the necessary distance is already secured, the discharge processing is performed without performing the adjustment for the interval of the inter-image region. Hereinafter, the present exemplary embodiment will be described in more detail.

It is noted that according to the present exemplary embodiment, the configuration set by adding the control in a case where the adjustment for the interval of the inter-image region is not performed to the control described in the second exemplary embodiment is described. However, a similar control can also be added to the control described in the first exemplary embodiment. That is, according to the present exemplary embodiment, the control unit does not perform the adjustment of the interval in a case where the inter-image region reaches the secondary transfer part after a predetermined timing (processing execution timing) even when where the adjustment of the interval is not performed and also a case where the interval of the inter-image region which is at least sufficient for performing the adjustment processing is secured. However, the control unit can skip the adjustment of the interval in a case where the inter-image region is located at the secondary transfer part at a predetermined timing even when the adjustment of the interval is not performed and also a case where the interval of the inter-image region which is at least sufficient for performing the adjustment processing is secured.

Figure 15:
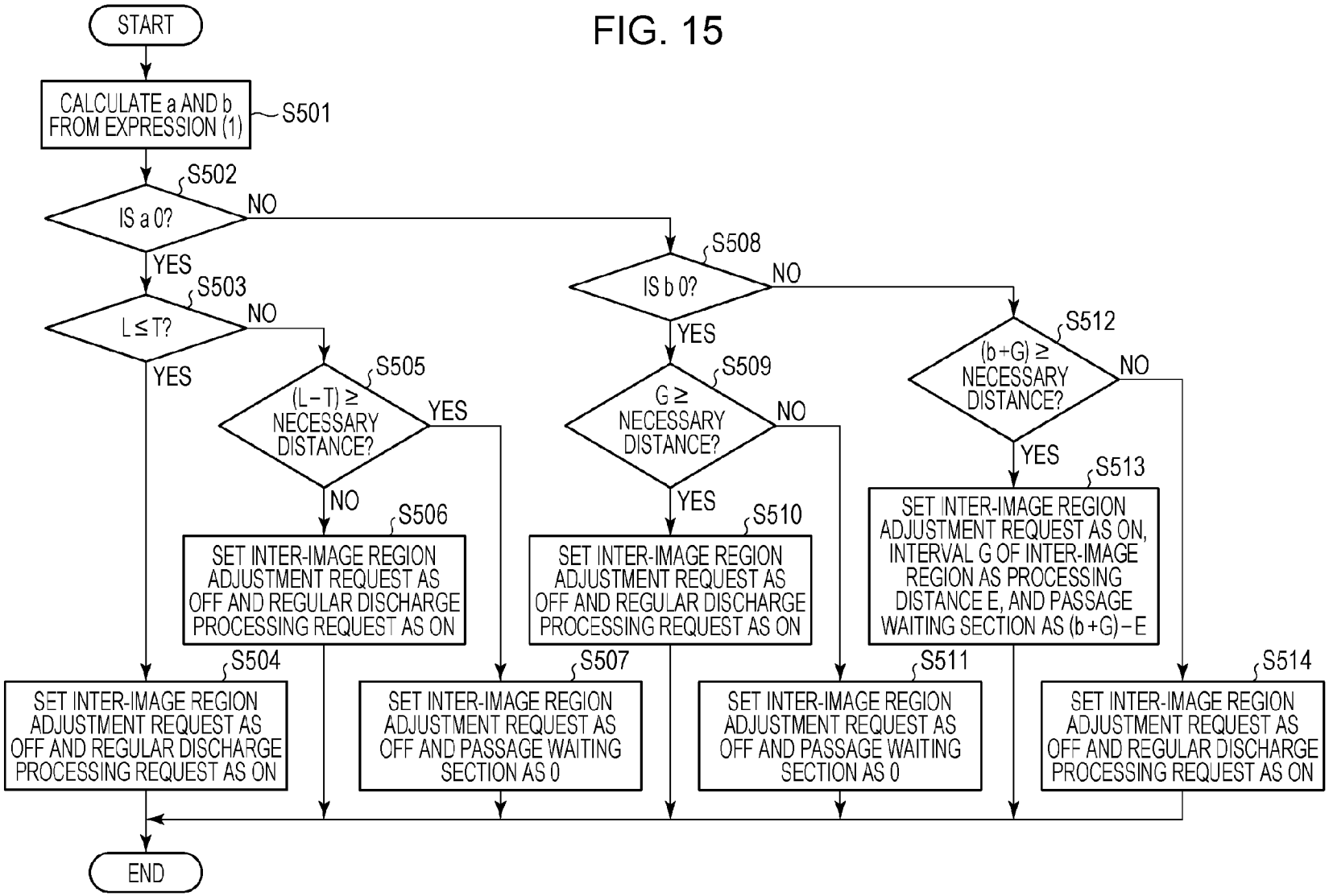
FIG. 15 is a flow chart illustrating another example of the processing such as the necessity determination on the adjustment for the interval of the inter-image region.

FIG. 15 is a flow chart for the processing of determining the necessity of the adjustment for the interval of the inter-image region, the position of the inter-image region where the interval is adjusted, the interval to be adjusted, and the like. It is noted that the processing of FIG. 15 is performed by the adjustment processing unit 216.

In the flow chart of FIG. 15, descriptions of parts similar to the flow chart of FIG. 12 described in the second exemplary embodiment are omitted, and different parts will be described.

Processes in S501 and S502 in FIG. 15 are similar to the processes in S301 to S302 in FIG. 12.

When it is determined in S502 that a is 0, in S503, the image size T is compared with the distance L between the primary transfer part N1 on the lowermost stream and the secondary transfer part N2. In S503, when it is determined that L≤T is established, in S504, similarly as in S303 in FIG. 12, the regular discharge processing request is set as ON, and the inter-image region adjustment request is set as OFF.

In S503, when it is determined that L>T is established, in S505, it is determined whether or not a condition of (L−T) ≥the necessary distance is satisfied. In S503, when it is determined that (L−T)<the necessary distance is established, since the secondary transfer of the image on the X-th sheet is already performed at the processing executable timing, in S506, the regular discharge processing request is set as ON, and the inter-image region adjustment request is set as OFF.

In S503, when it is determined that (L−T)≥the necessary distance is established, the inter-image region is already passing through the secondary transfer part N2 at the processing executable timing, and also, the section sufficient for the toner discharge is secured. For that reason, in S507, the inter-image region adjustment request is set as OFF, and the passage waiting section is set as 0.

In S502, when it is determined that a is not 0, the flow proceeds to the processing S508. In S508, it is determined whether or not the value b calculated by Expression (1) is 0. In S508, when it is determined that b is 0, the flow proceeds to the processing S509. Then, in S509, it is determined whether or not the condition of the inter-image region G<the necessary distance is satisfied. In S509, when it is determined that the inter-image region G<the necessary distance is established, the section sufficient for the toner discharge cannot be secured at the processing executable timing. For that reason, in S510, similarly as in S305 in FIG. 12, the regular discharge processing request is set as ON, and the inter-image region adjustment request is set as OFF.

In S509, when it is determined that the inter-image region G≥the necessary distance is established, the inter-image region is already passing through the secondary transfer part N2 at the processing executable timing, and also, the section sufficient for the toner discharge can be secured. For that reason, in S511, the inter-image region adjustment request is set as OFF, and the passage waiting section is set as 0.

Processes in S512 to S514 are similar to the processes in S306 to S308 in FIG. 12.

It is noted that the flow chart of the discharge processing according to the present exemplary embodiment is similar to FIG. 13 described in the second exemplary embodiment.

As described above, according to the present exemplary embodiment, in a case where the non-image region necessary for switching the polarity of the potential generated at the secondary transfer part N2 is already secured at the timing for switching the polarity of the potential generated at the primary transfer part N1 for the adjustment processing, the adjustment for the interval of the inter-image region is not performed. Accordingly, the interval of the inter-image region is not unnecessarily adjusted, and the productivity can be further improved.

Others

The present invention has been described above by way of the specific exemplary embodiments, but the present invention is not limited to the above-described exemplary embodiments.

For example, a configuration may be adopted in which the primary transfer rollers (primary transfer members) are arranged at positions facing the respective photosensitive drums 1 of the respective image forming units S via the intermediate transfer belt 10, and a common power source is connected to the respective primary transfer rollers and the secondary transfer roller 20. This configuration is also a configuration where the polarities of the potentials generated at the primary transfer part and the secondary transfer part cannot be independently controlled.

For example, according to the above-described exemplary embodiments, the control related to the discharge processing has been described as an example of the adjustment processing, but the present invention is not intended to limit the adjustment processing to this processing. In the case of the adjustment processing too where the potential having the opposite polarity with respect to the polarity upon the transfer is to be generated at the secondary transfer part, it may be conceivable that the adjustment processing in which the potential having the opposite polarity with respect to the polarity upon the transfer is to be generated at the secondary transfer part is executed at the same timing as the execution timing for the adjustment processing according to the above-described exemplary embodiments. Alternatively, the adjustment processing in which the potential having the opposite polarity with respect to the polarity upon the transfer is to be generated at both of the primary transfer part and the secondary transfer part at the same time may be executed. That is, the adjustment processing in which the potential having the opposite polarity with respect to the polarity upon the transfer is to be generated for at least one of the primary transfer part and the secondary transfer part may be executed. It is noted that according to the above-described exemplary embodiments, the discharge toner image of the discharge processing is formed by the respective processes including the charging, the exposure, and the development, but the configuration is not limited to this. For example, the toner may be discharged by a potential difference between the potential of the photosensitive drum and a potential of a developer bearing member of the development apparatus to which the voltage is applied without performing the charging and the exposure. It is sufficient if the photosensitive member can be supplied with the toner to be then supplied to the cleaning unit.

In addition, according to the above-described exemplary embodiments, the case where the adjustment processing is executed in the inter-image region during the continuous image formation has been described, but the configuration can also be applied to the case where the adjustment processing is executed after the last image formation. This case can be considered as a case where the image formation resumed after the adjustment processing according to the above-described exemplary embodiments (the remaining image formation in the continuous image formation) is absent. In this case too, after the adjustment processing is executed, it is possible to shorten the time until when the subsequent job (the series of image forming operations with respect to a single or a plurality of transfer materials by a single image formation starting instruction) can be started. Therefore, for example, in a case where a plurality of jobs to be executed or the like stand by, it is possible to improve the productivity as a whole. The position where the interval of the inter-image region is adjusted may be any position in the interval of the inter-image region before the processing executable timing. Furthermore, according to the above-described exemplary embodiments, the description has been made while the image size is mainly defined by an LTR size, and the number of positions where the interval of the inter-image region is adjusted is set as 1, but the number of positions where the interval of the inter-image region is adjusted may take a multiple value in accordance with the image size.

In addition, according to the above-described exemplary embodiments, the three stretching rollers are connected to the common zener diode, but the configuration is not limited to this. The zener diode may be individually connected to each of the plurality of stretching rollers. Furthermore, a part of the plurality of stretching rollers (for example, one or two of the three stretching rollers according to the above-described exemplary embodiments) may be connected to a common or individual zener diode.

In addition, according to the above-described exemplary embodiments, the intermediate transfer belt substantially abuts against the respective photosensitive drums of the respective image forming units by its tension alone, but the configuration is not limited to this. For example, a conductive member such as a metallic roller may be arranged in the primary transfer parts of the respective image forming units in a position facing the photosensitive drum or the like (which may be a position between the primary transfer parts). Then, this conductive member may be connected to the zener diode similarly as in the stretching roller.

In addition, according to the above-described exemplary embodiments, the zener diode is used as a constant voltage element (voltage stabilizer), but other element such as, for example, a varistor may also be used as long as similar advantages can be attained.

In addition, according to the above-described exemplary embodiments, the secondary transfer roller, the conductive brush, and the conductive roller have a function of a current supply member (conductive member) that causes a current to flow through the intermediate transfer belt by contacting the outer peripheral surface of the intermediate transfer belt and being applied with the voltage. Then, the overlapped voltage from the plurality of power sources is applied to cause the current to flow through the intermediate transfer belt. However, the configuration is not limited to this, and for example, only the current from the power source that applies the voltage to the secondary transfer member may be caused to flow through the intermediate transfer belt. For example, in the image forming apparatus that adopts a cleaning blade to which the voltage is not applied instead of the conductive blush 16 and the conductive roller 17 and collects the toner from the intermediate transfer belt 10 by the cleaning blade, the potential of the primary transfer part N1 can be switched by the output of the transfer power source 21.

In addition, according to the above-described exemplary embodiments, the secondary transfer residual toner on the intermediate transfer belt is charged and then moved to the photosensitive drum at the same time as the primary transfer to be collected, but the configuration is not limited to this. For example, the secondary transfer residual toner may be removed and collected by a cleaning member such as a cleaning blade.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-013804, filed Jan. 28, 2014, which is hereby incorporated by reference herein in its entirety.

What is claimed is:

1. An image forming apparatus comprising:

an image bearing member that bears a toner image;

an intermediate transfer member that is rotatable and transfers a toner image transferred from the image bearing member at a primary transfer part onto a transfer material at a secondary transfer part;

a switching unit that can switch polarities of potentials of the intermediate transfer member which are generated at the primary transfer part and the secondary transfer part in synchronization; and a control unit that executes adjustment processing in which a potential having a first polarity opposite to the polarity upon the transfer is to be generated at least one of the primary transfer part and the secondary transfer part, wherein the control unit controls the switching unit in a manner that, in a case where the adjustment processing is performed in a course of continuous image formation on a plurality of transfer materials conveyed to the secondary transfer part, a timing for generating the potential having the first polarity corresponds to a timing at which toner images are not transferred at both of the primary transfer part and the secondary transfer part.

2. The image forming apparatus according to claim 1, wherein the control unit performs an adjustment to expand an interval of an inter-image region that reaches the secondary transfer part ahead of the image at the primary transfer part immediately before the timing and cause the inter-image region to be located at the secondary transfer part while the adjustment processing is executed.

3. The image forming apparatus according to claim 2, wherein, the control unit determines a position of the inter-image region where the adjustment of the interval is performed and an interval after the adjustment on the basis of a size of images that are to be at least partially located between the primary transfer part and the secondary transfer part at the timing in a case where the adjustment of the interval is not performed and an interval of an inter-image region between the images.

4. The image forming apparatus according to claim 2, wherein the control unit determines a position of the inter-image region and an interval after the adjustment in a manner that an inter-image region where the adjustment of the interval is performed reaches the secondary transfer part at the timing, and the interval of the inter-image region which is at least sufficient for executing the adjustment processing is secured.

5. The image forming apparatus according to claim 2, wherein the control unit determines a position of the inter-image region and an interval after the adjustment in a manner that an inter-image region where the adjustment of the interval is performed reaches the secondary transfer part after the timing, and the interval of the inter-image region which is at least sufficient for executing the adjustment processing is secured.

6. The image forming apparatus according to claim 1, wherein the control unit adjusts an interval of an inter-image region between an image located at the secondary transfer part or located immediately before the secondary transfer part at the timing and an image that reaches the secondary transfer part subsequent to the image located at or located immediately before the secondary transfer part.

7. The image forming apparatus according to claim 2, wherein the control unit does not perform the adjustment of the interval in a case where, even when the adjustment of the interval is not performed, the inter-image region is located at the secondary transfer part at the timing and the interval of the inter-image region which is at least sufficient for executing the adjustment processing is secured.

8. The image forming apparatus according to claim 2, wherein the control unit does not perform the adjustment of the interval in a case where, even when the adjustment of the interval is not performed, the inter-image region reaches the secondary transfer part after the timing and the interval of the inter-image region which is at least sufficient for executing the adjustment processing is secured.

9. The image forming apparatus according to claim 2, wherein the control unit does not perform the adjustment for the interval of the inter-image region in a case where the interval sufficient for executing the adjustment processing is not secured even when the interval of the inter-image region that reaches the secondary transfer part ahead of an image at the primary transfer part immediately before the timing is adjusted.

10. The image forming apparatus according to claim 1, wherein the adjustment processing is processing in which toner of a predetermined image formed on the image bearing member is not transferred onto the intermediate transfer member and is supplied to a cleaning member that removes the toner from the image bearing member.

11. The image forming apparatus according to claim 1, wherein the switching unit includes a secondary transfer member that contacts an outer peripheral surface of the intermediate transfer member at the secondary transfer part and a transfer power source that applies a voltage to the secondary transfer member, and the voltage is applied to the secondary transfer member from the transfer power source to change potentials of the primary transfer part and the secondary transfer part.

12. The image forming apparatus according to claim 11, wherein the transfer power source supplies a current in a circumferential direction of the intermediate transfer member via the secondary transfer member to perform primary transfer from the image bearing member onto the intermediate transfer member at the primary transfer part.

13. The image forming apparatus according to claim 11, wherein the switching unit includes a charging device that charges toner remaining on the intermediate transfer member and a charging power source that applies a charging bias to the charging device.

14. The image forming apparatus according to claim 11, wherein the charging power source changes a polarity of the applied voltage in synchronism with the transfer power source.

15. The image forming apparatus according to claim 11, wherein the charging device includes a charge brush.

16. An image forming apparatus comprising:

an image bearing member that bears a toner image;

an intermediate transfer member that is rotatable and transfers a toner image transferred from the image bearing member at a primary transfer part onto a transfer material at a secondary transfer part;

a switching unit that can switch polarities of potentials of the intermediate transfer member which are generated at the primary transfer part and the secondary transfer part in synchronization; and a controlling unit configured to control the switching unit and switch polarities of potentials of the intermediate transfer member which are generated at the primary transfer part and the secondary transfer part when continuously forming images according to a plurality of transfer materials conveyed to the secondary transfer part, wherein the controlling unit causes the polarities of potentials of the intermediate transfer member which are generated at the primary transfer part and the secondary transfer part to have a same polarity as a charging polarity corresponding to a regular charging polarity of a toner, at a timing of not transferring a toner image both with the primary transfer part and the secondary transfer part.

* * * * *